US008820870B2

(12) United States Patent
Kumagai et al.

(10) Patent No.: US 8,820,870 B2
(45) Date of Patent: Sep. 2, 2014

(54) RECORDING APPARATUS

(71) Applicant: Seiko Epson Corporation, Tokyo (JP)

(72) Inventors: Katsunari Kumagai, Okaya (JP); Kazumasa Harada, Matsumoto (JP); Tomoya Takikawa, Yokohama (JP); Kazutoshi Matsuzaki, Shiojiri (JP); Hidetaka Kawata, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/936,073

(22) Filed: Jul. 5, 2013

(65) Prior Publication Data

US 2014/0009519 A1 Jan. 9, 2014

(30) Foreign Application Priority Data

Jul. 6, 2012 (JP) ..... 2012-152139

(51) Int. Cl.
*B41J 25/308* (2006.01)
*B41J 23/12* (2006.01)
*B41J 2/04* (2006.01)

(52) U.S. Cl.
CPC ..... *B41J 2/04* (2013.01); *B41J 25/3082* (2013.01)
USPC ..... 347/8; 347/37

(58) Field of Classification Search
CPC ..... B41J 25/3082
See application file for complete search history.

(56) References Cited

U.S. PATENT DOCUMENTS

| | | | | |
|---|---|---|---|---|
| 2006/0132515 | A1* | 6/2006 | Buonerba et al. | 347/8 |
| 2007/0008352 | A1* | 1/2007 | Koh et al. | 347/8 |
| 2007/0122220 | A1 | 5/2007 | Tamaki et al. | |
| 2008/0297560 | A1* | 12/2008 | Kuriki et al. | 347/37 |
| 2009/0309921 | A1* | 12/2009 | Ohyama et al. | 347/37 |
| 2009/0309922 | A1* | 12/2009 | Iwakura | 347/37 |

FOREIGN PATENT DOCUMENTS

| | | |
|---|---|---|
| JP | 2007-144766 | 6/2007 |
| JP | 2011-031627 | 2/2011 |

* cited by examiner

*Primary Examiner* — Shelby Fidler
(74) *Attorney, Agent, or Firm* — Workman Nydegger

(57) ABSTRACT

A recording apparatus includes a carriage that is provided with a recording head which performs recording on a recording medium and is movable in a scan direction of the recording head, a guide member that guides the carriage in the scan direction, and a gap adjusting unit that is interposed between a housing of the carriage and the guide member so as to displace the housing of the carriage in a direction in which a gap varies between the recording medium and the recording head, the gap adjusting unit being mounted on the carriage.

6 Claims, 20 Drawing Sheets

RECORDING APPARATUS

BACKGROUND

1. Technical Field

The present invention relates to recording apparatuses that include a mechanism that adjusts a distance between a recording medium and a recording head. The recording apparatuses described herein may include, for example, ink jet printers, copying machines and facsimile machines.

2. Related Art

Recording apparatuses generally include a carriage that is movable in a scan direction of a recording head which is mounted on the underside of the carriage and is configured to eject ink onto a recording surface of a recording medium. Some types of recording apparatuses perform recording on the recording medium such as an envelop, a thick paper sheet and an optical disk as well as a plain paper.

Since various recording media have different thicknesses, a distance between the recording head and the recording surface of the recording medium varies depending on the thickness of the recording medium, and the distance between the recording head and a supporting surface of the recording medium needs to be changed accordingly. JP-A-2010-23501 discloses the recording apparatus that is configured to move the carriage in a direction in which the distance is adjusted between the recording head and the supporting surface of the recording medium depending on the type of the recording medium.

The recording apparatus includes a sliding section that moves with the carriage in the scan direction. The sliding section is configured to be in direct contact with and slide on a guide section. The recording apparatus further includes a distance control member between the sliding section and the carriage. The distance control member is configured to change the thickness in the direction in which the distance is adjusted across the scan direction.

The recording apparatus further includes a switching section that slides the distance control member in the scan direction. The switching section is configured to extend and retract through an opening on the guide section in an area in which the distance control member slides. Further, the distance control member has a protrusion on the surface that opposes the switching section.

The recording apparatus is configured to adjust the distance between the recording head and the supporting surface of the recording medium by moving the distance control member relative to the carriage in the scan direction and by moving the carriage in the direction in which the distance is adjusted.

In the recording apparatus, during adjustment of the distance, the distance control member moves relative to the carriage in the scan direction while the distance control member moves relative to the sliding section in the direction in which the distance is adjusted. As the distance control member moves in the direction in which the distance is adjusted, the protrusion also moves in the direction in which the distance is adjusted. Since the position of the protrusion in the direction in which the distance is adjusted varies depending on the distance, it has been necessary that the switching section that engages the protrusion has a large engagement surface that engages the protrusion which is large in the direction in which the distance is adjusted.

However, with the engagement surface of the switching section which is large in the direction in which the distance is adjusted, a large opening of the guide rail is also necessary. This may reduce the rigidity of the guide rail. As a result, when the carriage moves in the scan direction, the carriage may be displaced in the direction in which the distance is adjusted due to deformation of the guide rail, which causes a problem in maintaining a constant distance, leading to a decreased quality of recording. In addition, since the size of the switching section is large, the other components should be positioned so as not to interfere with an operation of the switching section, which causes the recording apparatus to be large-sized.

SUMMARY

An advantage of some aspects of the invention is that a recording apparatus is provided which performs a switching operation for adjusting the distance between the recording medium and the recording head and performs adjustment of the distance at a constant position in the direction in which the distance between the support section of the recording medium and the recording head is adjusted.

According to a first aspect of the invention, a recording apparatus includes a carriage that is provided with a recording head which performs recording on a recording medium and is movable in a scan direction of the recording head, a guide member that guides the carriage in the scan direction, and a gap adjusting unit that is interposed between a housing of the carriage and the guide member so as to displace the housing of the carriage in a direction in which a gap varies between a support section that supports the recording medium and the recording head, the gap adjusting unit being mounted on the carriage, wherein the gap adjusting unit includes a sliding member that slides relative to the guide member, a cam member that is interposed between part of the housing and the sliding member and has a shape that allows the housing of the carriage to be displaced in the direction in which the gap varies by sliding in the scan direction relative to the housing and the sliding member, and an engagement member that slides with the cam member in the scan direction, engages the cam member in the direction in which the gap varies in a manner that allows movement of the cam member, and abuts against the switching member which is configured to extend and retract with respect to a movement area of the carriage to slide the cam member.

Accordingly, the engagement member slides with the cam member in the scan direction and abuts against the switching member so as to slide the cam member, thereby adjusting the gap. When the engagement member slide in the scan direction, the engagement member slides at a constant position in the direction in which the gap varies.

As a result, since the engagement member slides in the scan direction at a constant position in the direction in which the gap varies, a surface of the switching member which abuts against the engagement member can be reduced in size.

Consequently, a cutout formed on the guide member so as to allow the switching member to extend and retract with respect to the movement area of the carriage can be reduced in size, which eliminates or reduces a risk of decreasing the rigidity of the guide member. Therefore, independently of the movement of the carriage in the scan direction, the gap can remain the same and the recording quality is prevented from decreasing.

According to a second aspect of the invention, the engagement member in the first aspect is provided with movement thereof in the direction in which the gap varies is regulated.

Accordingly, in addition to the effect of the first aspect, a position of the engagement member which abuts against the switching member can be constant in the direction in which the gap varies since the movement of the engagement member in the direction in which the gap varies is regulated. As a result, a portion of the switching member which abuts against the engagement member is not displaced in the direction in which the gap varies.

Consequently, when the switching member is provided as a lever member, the lever portion which abuts against the engagement member can be reduced in size and a distance from a rotation shaft of the lever to the lever portion can be also reduced, thereby reducing the rotation radius of the lever member. As a result, the cutout formed on the guide member to allow the lever member to extend to the movement area of the carriage can be reduced in size.

Since the switching member can be reduced in size, an area around the switching member where the switching member interferes with the other members can be also reduced in size, and accordingly, the recording apparatus can be reduced in size.

According to a third aspect of the invention, in the first or second aspect, the guide member and the sliding member engage each other with relative displacement thereof in the direction in which the gap varies is regulated, the sliding member and the cam member engage each other with relative displacement thereof in the direction in which the gap varies is regulated, and the cam member and the housing engage each other with relative displacement thereof in the direction in which the gap varies is regulated.

Accordingly, in addition to the effect of the first or second aspect, since the sliding member engages the guide member with the displacement relative to the guide member in the direction in which the gap varies being regulated, the cam member engages the sliding member with the displacement relative to the sliding member in the direction in which the gap varies being regulated, and the housing engages the cam member with the displacement relative to the cam member in the direction in which the gap varies being regulated, the displacement of the housing relative to the guide member in the direction in which the gap varies is regulated.

As a result, when the carriage moves in the scan direction, the gap can be maintained to a predetermined distance without being changed, for example, due to rattling between components. Therefore, the quality of recording can be maintained in the recording apparatus.

According to a fourth aspect of the invention, in any one of the first aspect to the third aspect, the cam member engages the engagement member when a projection formed on the cam member is loosely inserted in an elongated hole formed on the engagement member, and the elongated hole is formed to be inclined by a predetermined angle relative to the direction in which the gap varies so that the projection in the elongated hole is guided to move in an appropriate direction with slide of the engagement member.

Accordingly, in addition to the effect of any one of the first aspect to the third aspect, when the cam member slides with slide of the engagement member, the projection can be easily displaced in the displacement direction since the elongated hole formed on the engagement member that engages the projection of the cam member is inclined at a predetermined angle relative to the direction in which the gap varies. That is, the movement of the engagement member in the scan direction can be easily converted into the movement of the cam member in the direction in which the gap varies.

According to a fifth aspect of the invention, in any one of the first aspect to the fourth aspect, the recording apparatus includes a first biasing unit that applies a biasing force in a direction by which the cam member is placed between the housing of the carriage and the sliding member.

Accordingly, in addition to the effect of any one of the first aspect to the fourth aspect, since the cam member is biased to the housing of the carriage by the first biasing unit, a rattling in the direction in which the gap varies can be prevented and the gap can be maintained to a predetermined distance, thereby preventing the recording quality from decreasing.

According to a sixth aspect of the invention, in any one of the first aspect to the fifth aspect, the guide member has a wall that extends in the direction in which the gap varies, and the sliding member is biased to the wall by a biasing force applied between the wall and the housing of the carriage by a second biasing unit.

Accordingly, in addition to the effect of the fifth aspect, since the sliding member is biased to the wall of the guide member by the second biasing unit, the sliding member can prevent a rattling of the guide member in the direction in which the gap varies and in a direction perpendicular to the scan direction. Therefore, it is possible to prevent the decrease of recording quality due to a rattling of the carriage in the direction perpendicular to the scan direction.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
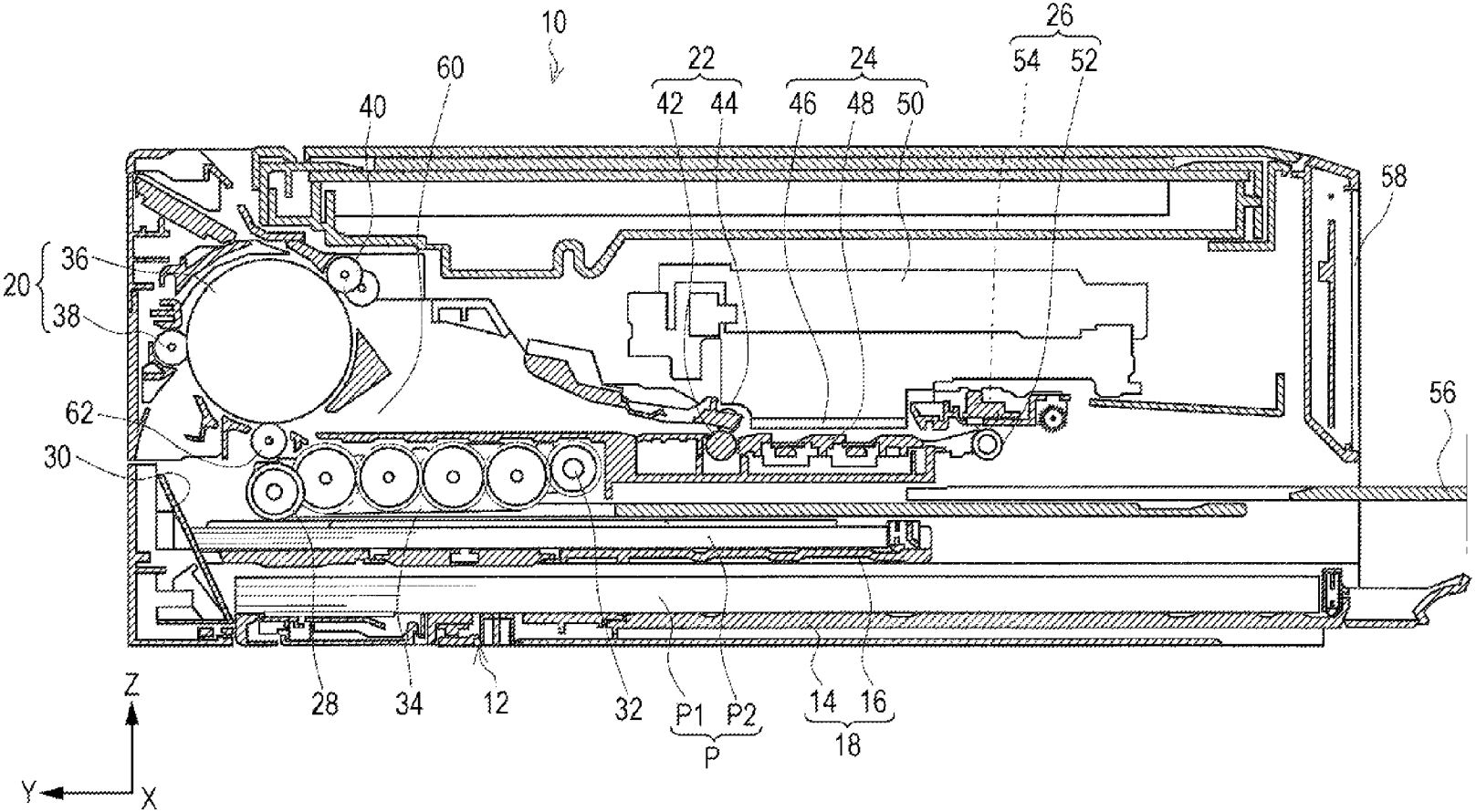
FIG. 1 is a side sectional view which shows a sheet transportation path of a printer according to the invention.

Embodiments of the invention will be described below with reference to the drawings. The same elements in different embodiments are denoted by the same reference numerals. The elements will be described in the embodiment in which they are first introduced and will not be further described in the subsequent embodiments.

Figure 2:
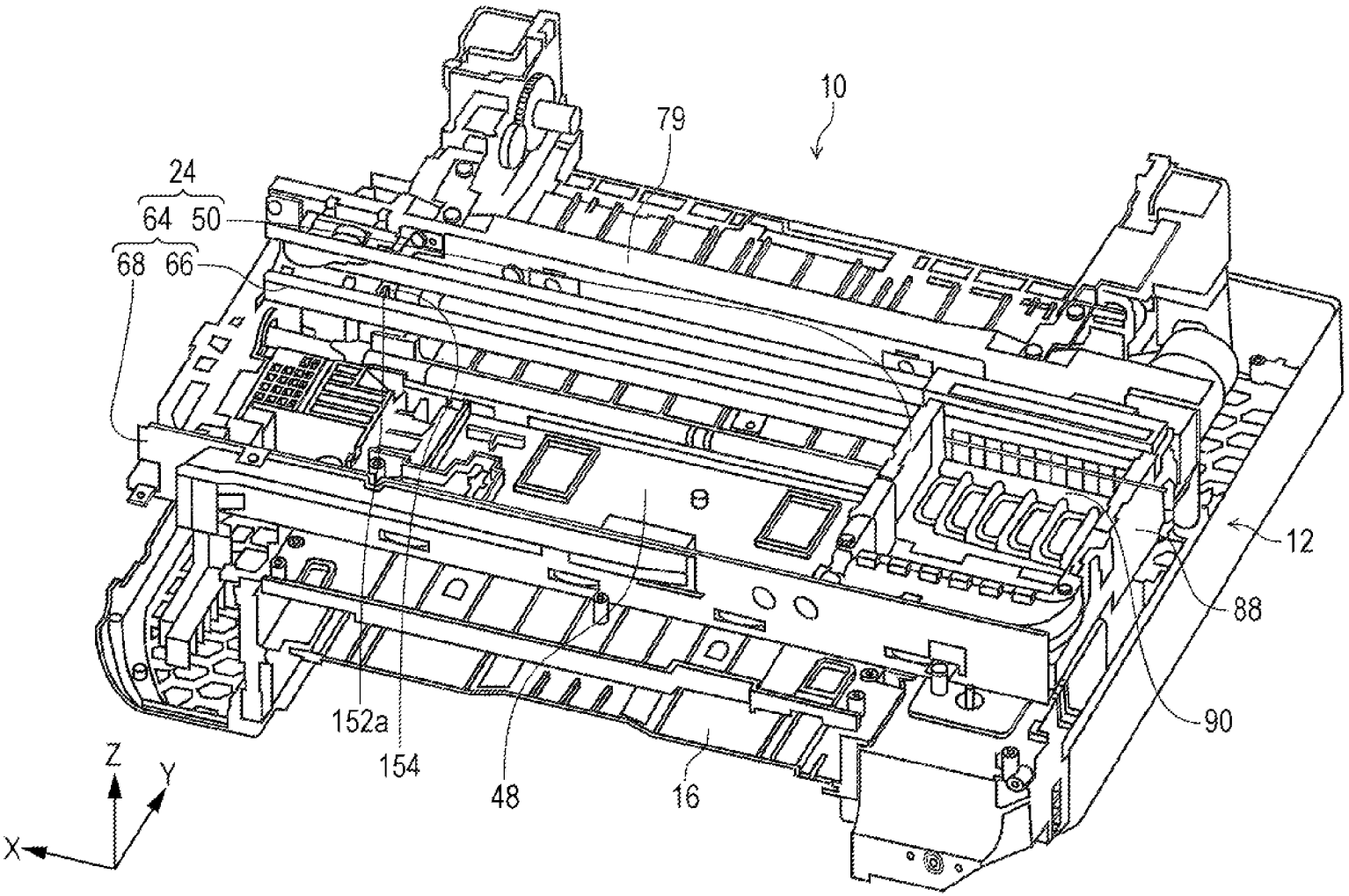
FIG. 2 is a perspective view of the printer according to the invention.
Figure 3:
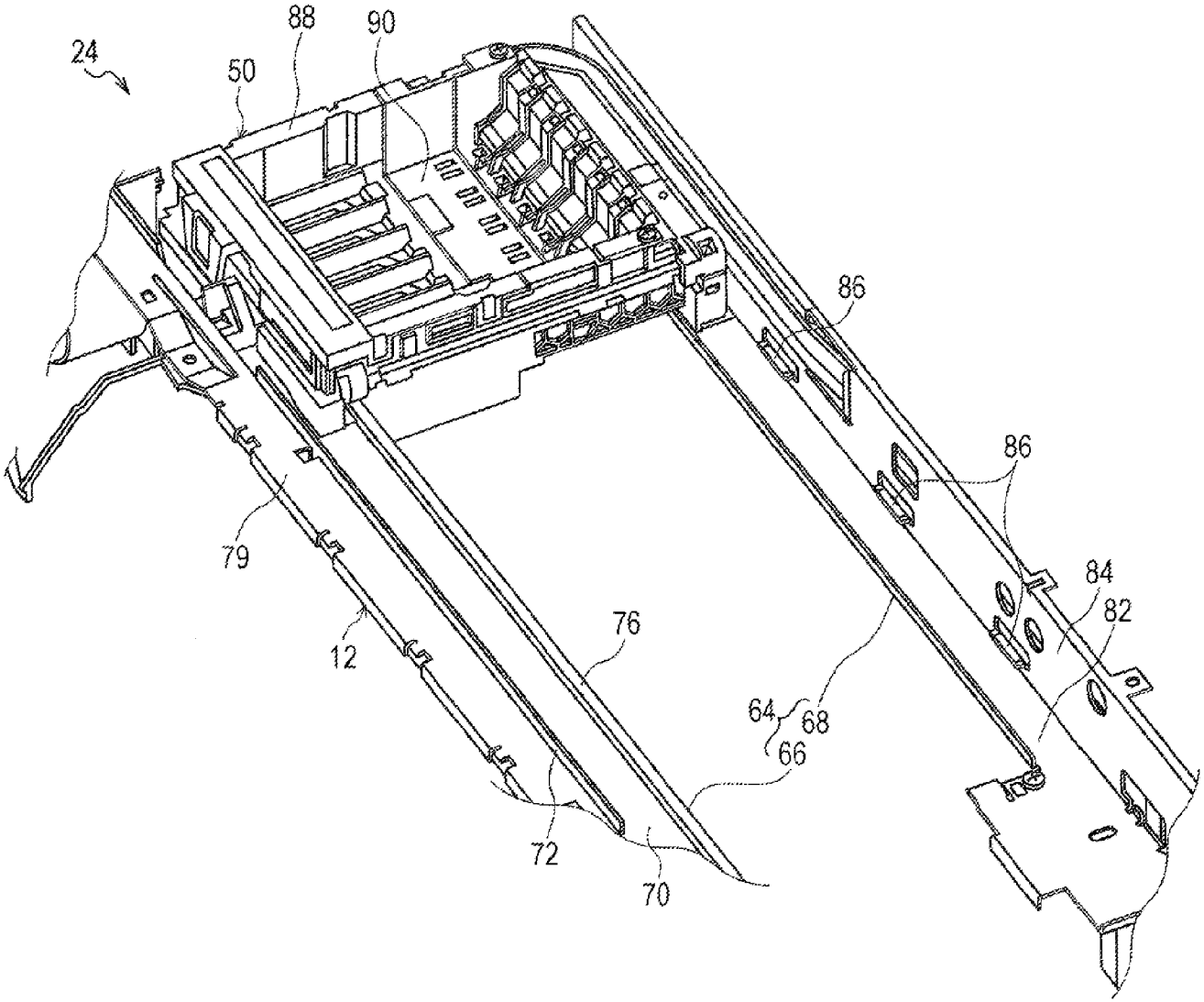
FIG. 3 is a perspective view of a carriage that is placed on a guide rail.
Figure 4A:
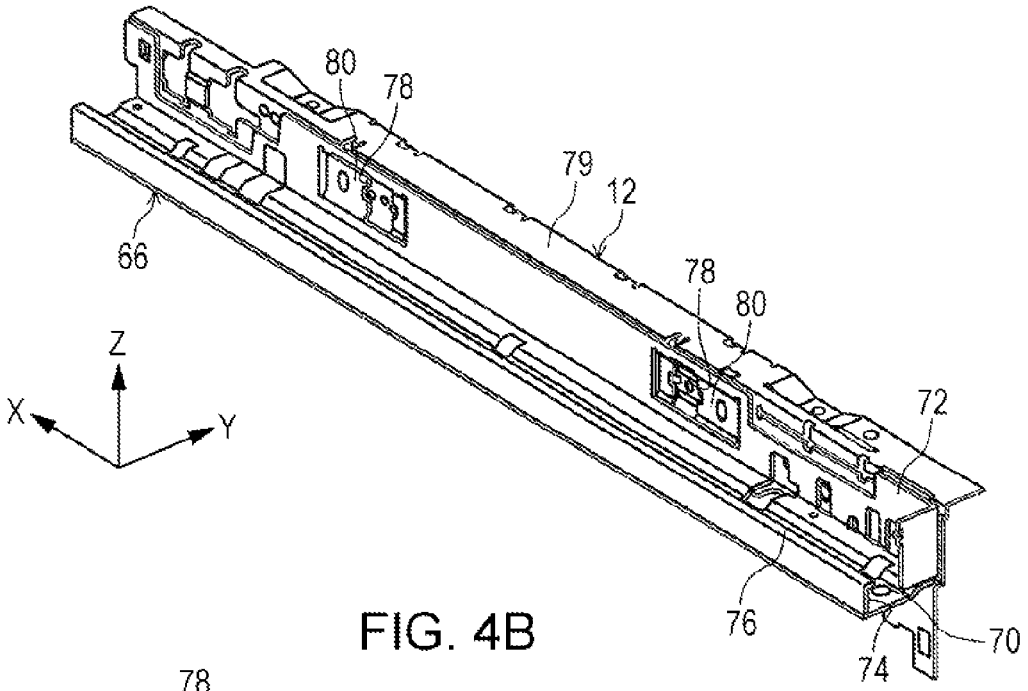
FIG. 4A is a perspective view of a main guide rail.
Figure 4B:
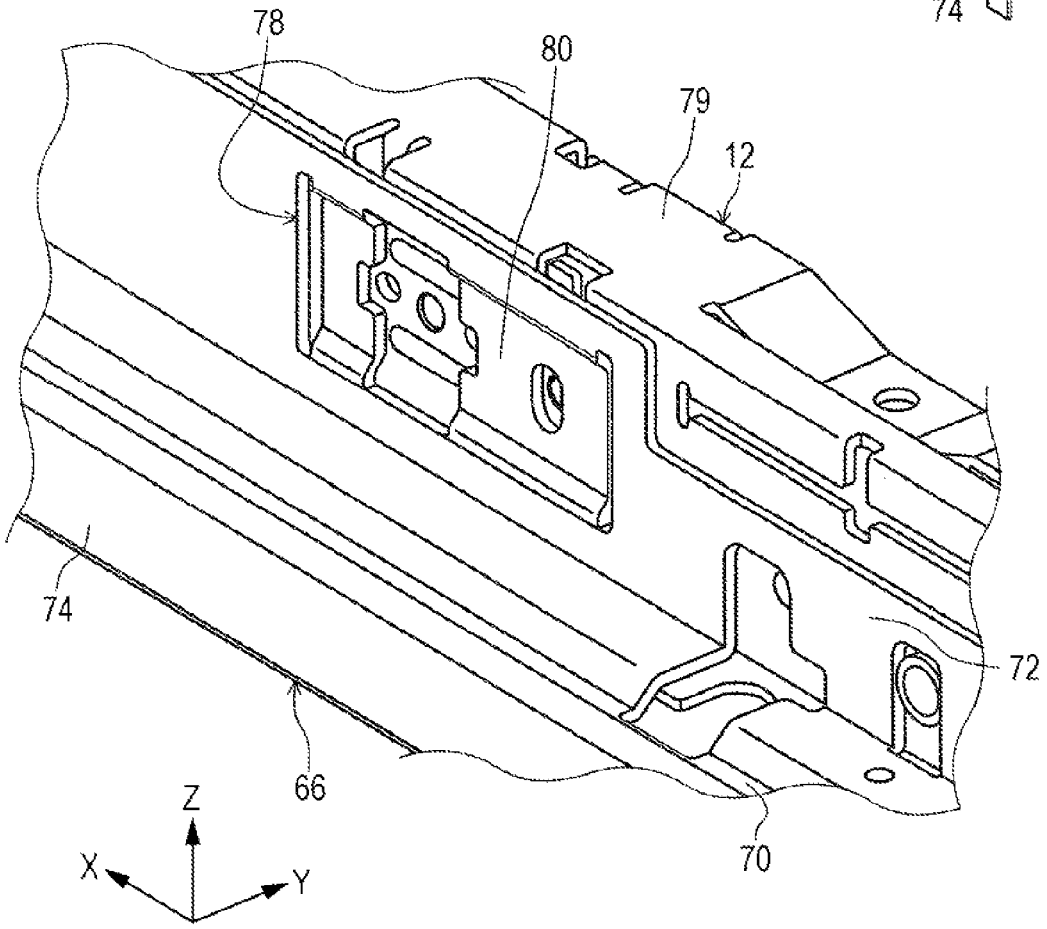
FIG. 4B is an enlarged perspective view of a mounting section of the main guide rail.
Figure 5A:
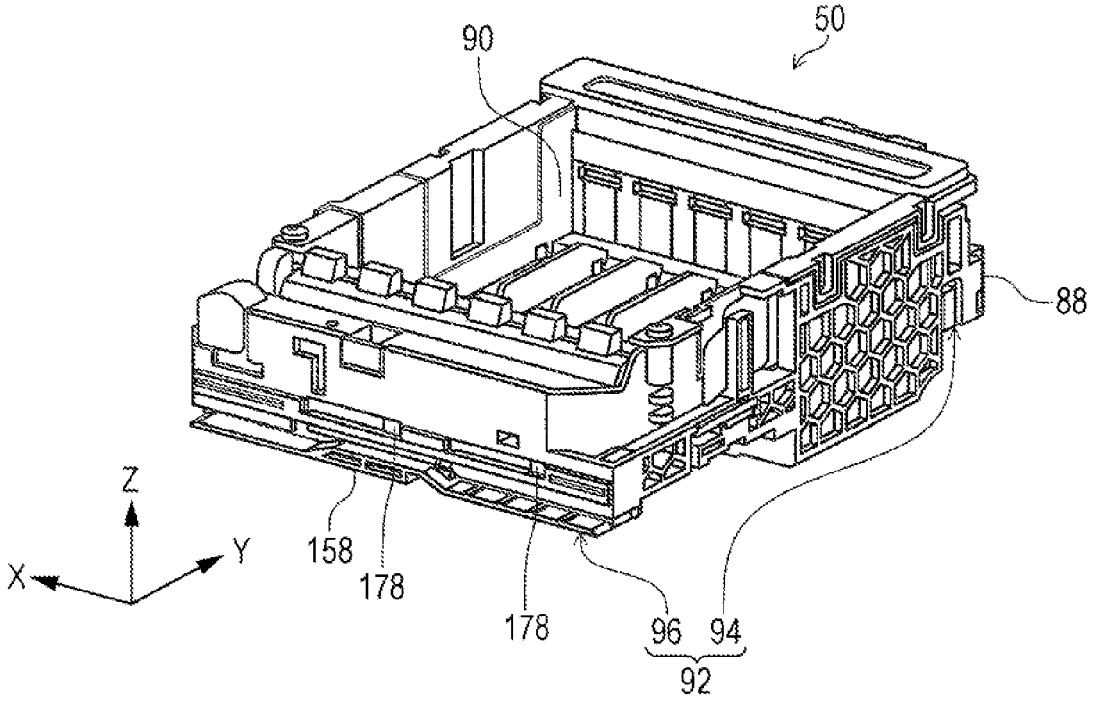
FIG. 5A is a perspective view seen from the front side of a housing of the carriage.
Figure 5B:
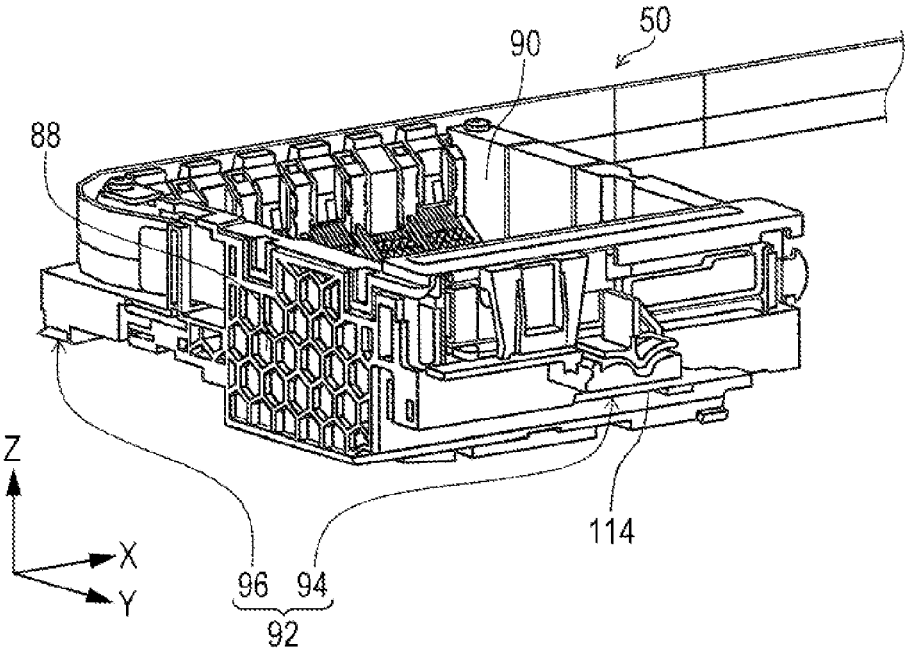
FIG. 5B is a perspective view seen from the back side of the housing of the carriage.

FIG. 1 is a side sectional view which shows a sheet transportation path of an ink jet printer (hereinafter, referred to as "printer") 10 which is an embodiment of the "recording apparatus." FIG. 2 is a perspective view of the printer according to the invention. FIG. 3 is a perspective view of a carriage that is placed on a guide rail. FIG. 4A is a perspective view of a main guide rail and FIG. 4B is an enlarged perspective view of a mounting section of the main guide rail. FIG. 5A is a perspective view seen from the front side of a housing of the carriage and FIG. 5B is a perspective view seen from the back side of the housing of the carriage.

Figure 6:
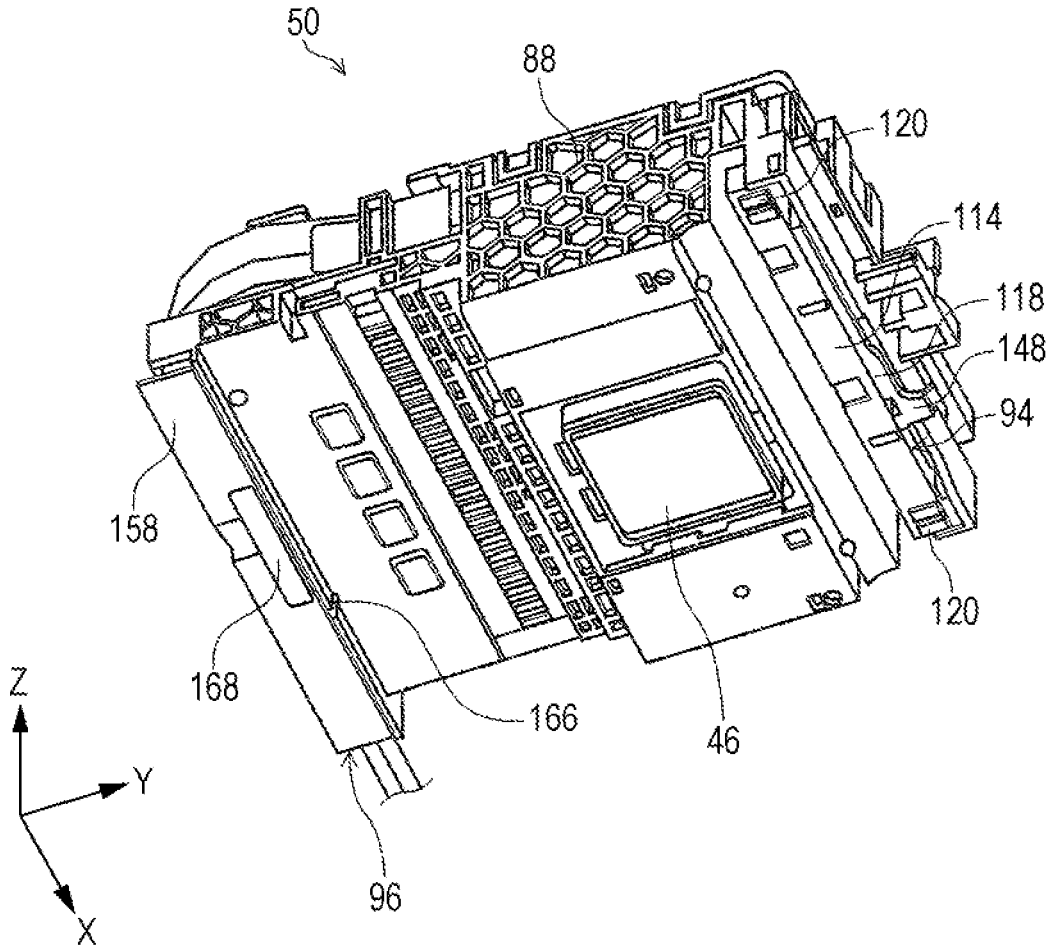
FIG. 6 is a perspective view seen from the bottom side of the housing of the carriage.
Figure 7:
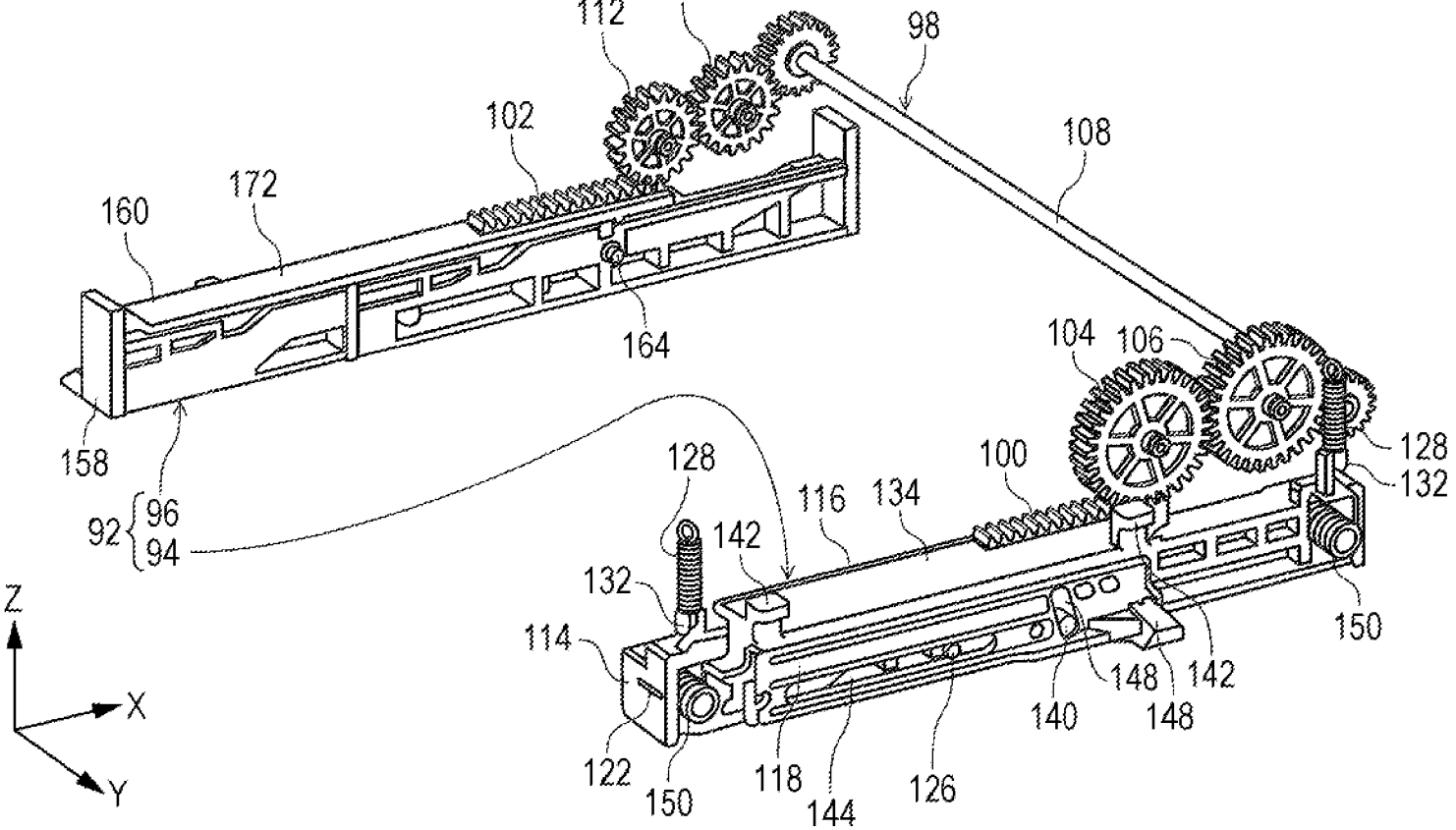
FIG. 7 is a perspective view of a gap adjusting unit.
Figure 8A:
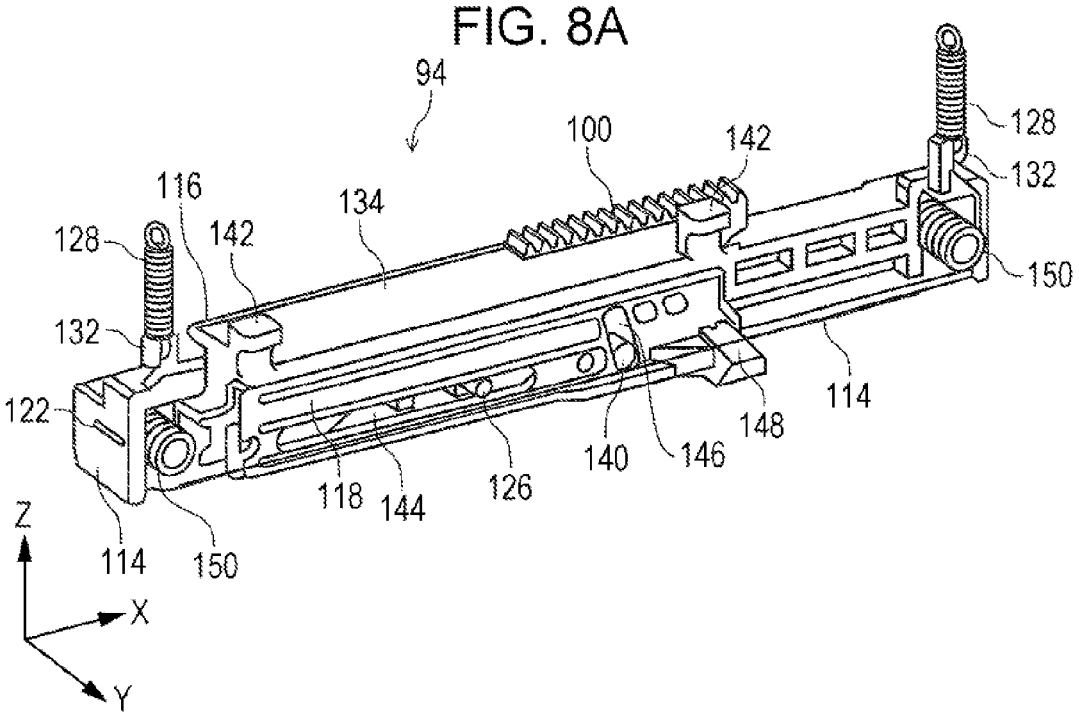
FIG. 8A is a perspective view of a main gap adjusting unit.
Figure 8B:
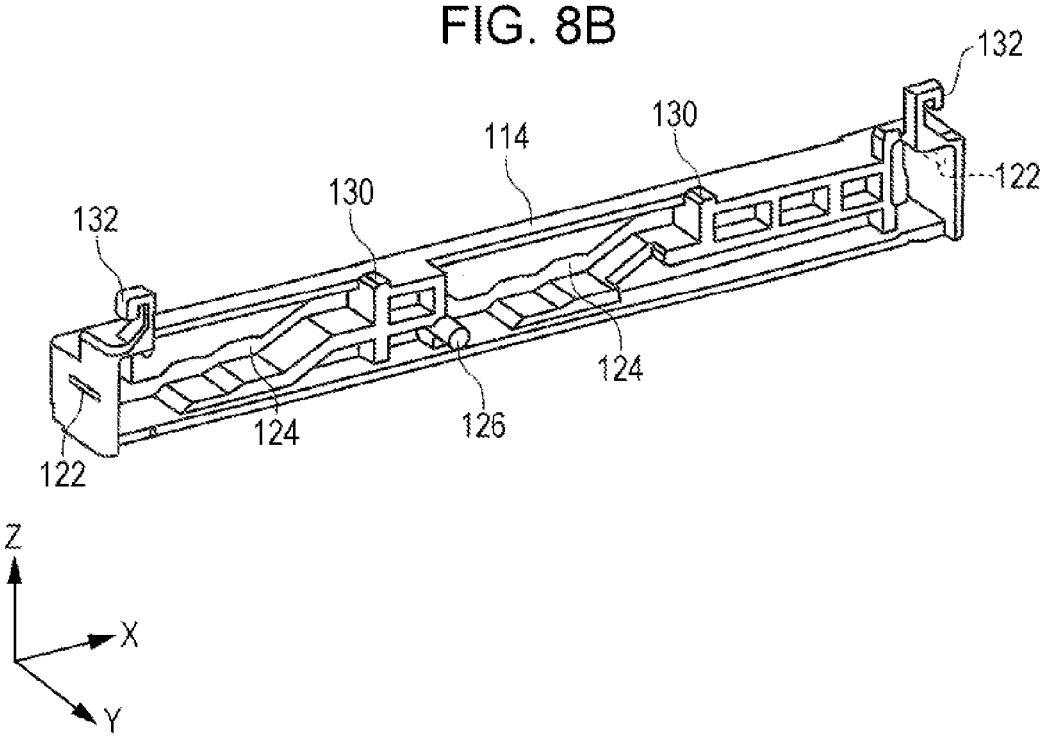
FIG. 8B is a perspective view of a sliding member of the main gap adjusting unit.
Figure 9A:
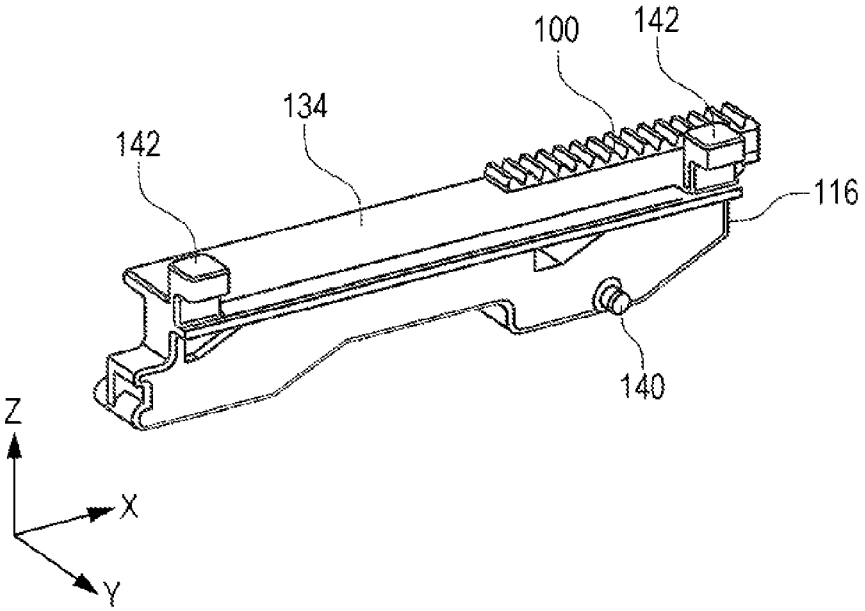
FIG. 9A is a perspective view of a cam member of the main gap adjusting unit.
Figure 9B:
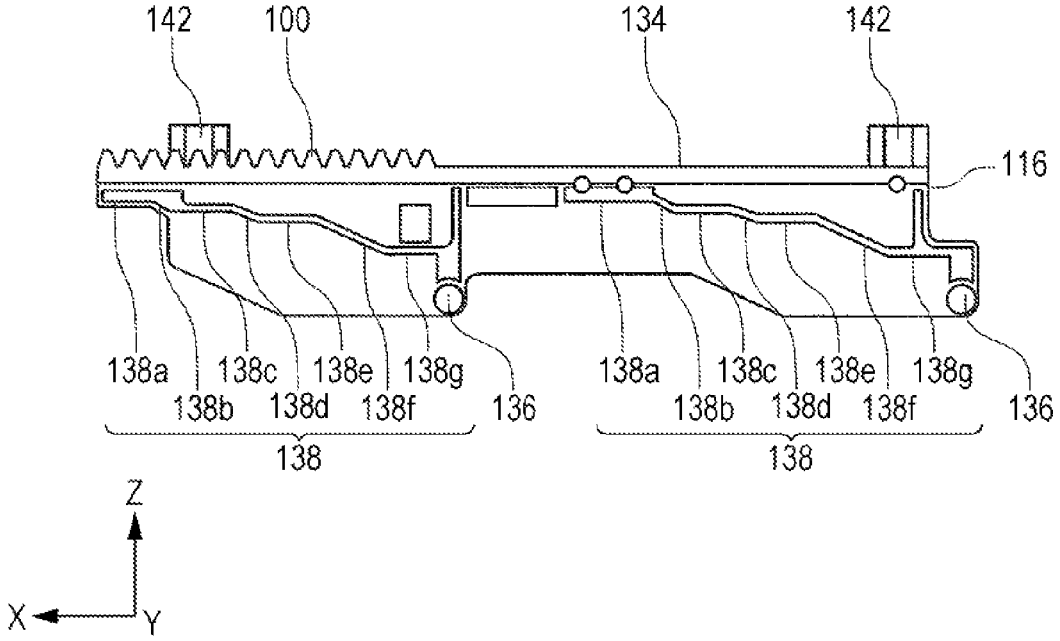
FIG. 9B is a front elevation view of the cam member of the main gap adjusting unit.
Figure 10:
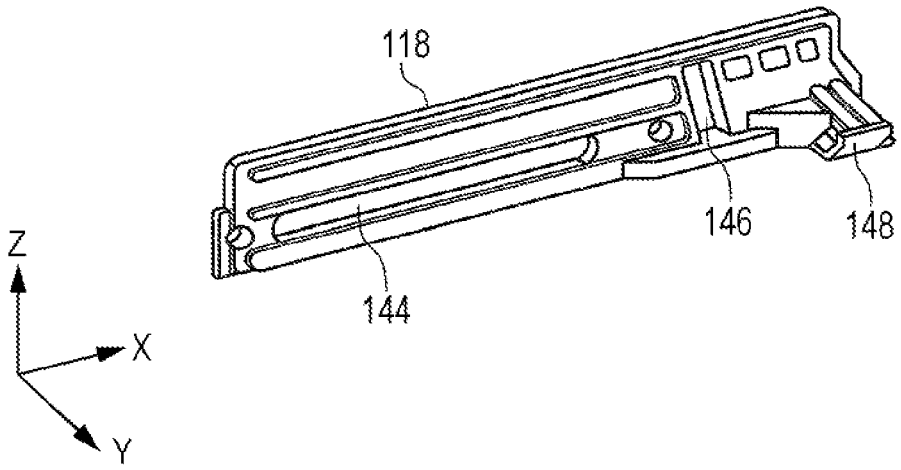
FIG. 10 is a perspective view of an engagement member of the main gap adjusting unit.
Figure 11:
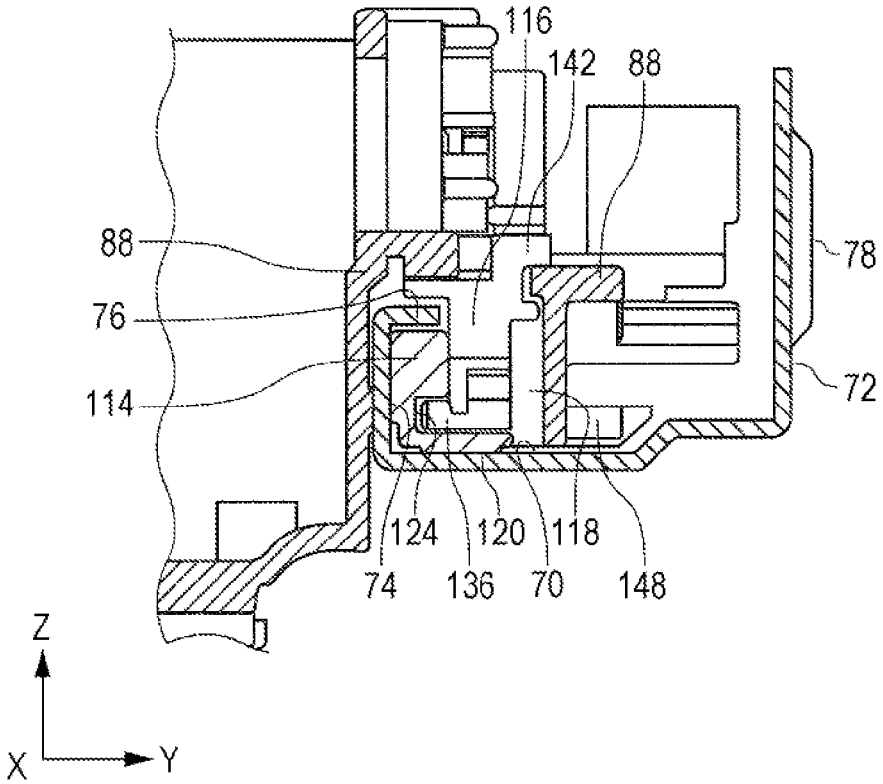
FIG. 11 is a sectional view of the main gap adjusting unit of FIG. 8A in the Y axis direction.

FIG. 6 is a perspective view seen from the bottom side of the housing of the carriage. FIG. 7 is a perspective view of a gap adjusting unit. FIG. 8A is a perspective view of a main gap adjusting unit and FIG. 8B is a perspective view of a sliding member of the main gap adjusting unit. FIG. 9A is a perspective view of a cam member of the main gap adjusting unit and FIG. 9B is a front elevation view of the cam member of the main gap adjusting unit. FIG. 10 is a perspective view of an engagement member of the main gap adjusting unit. FIG. 11 is a sectional view of the main gap adjusting unit of FIG. 8A in the Y axis direction.

Figure 12:
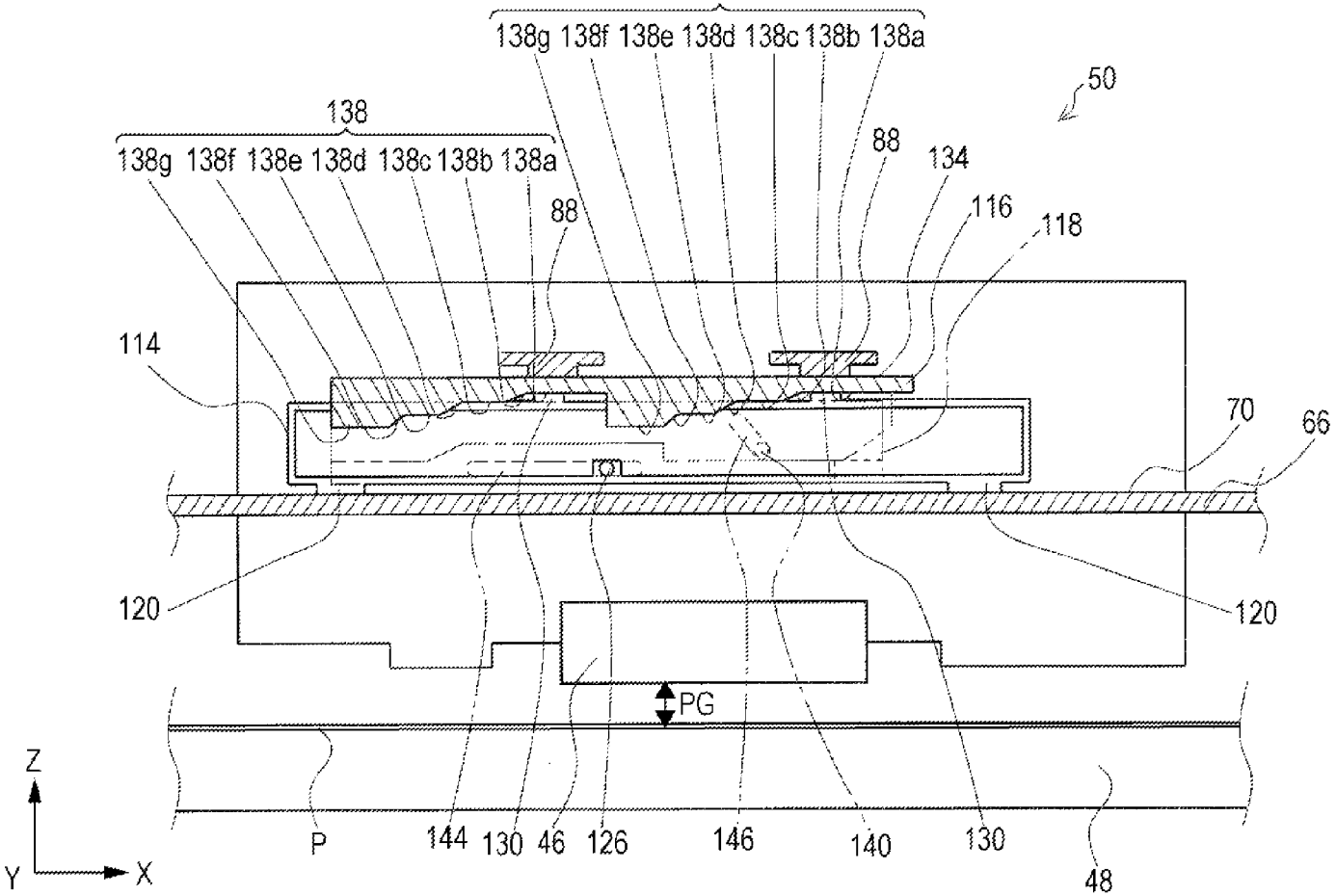
FIG. 12 is an explanatory view of gap adjustment.
Figure 13:
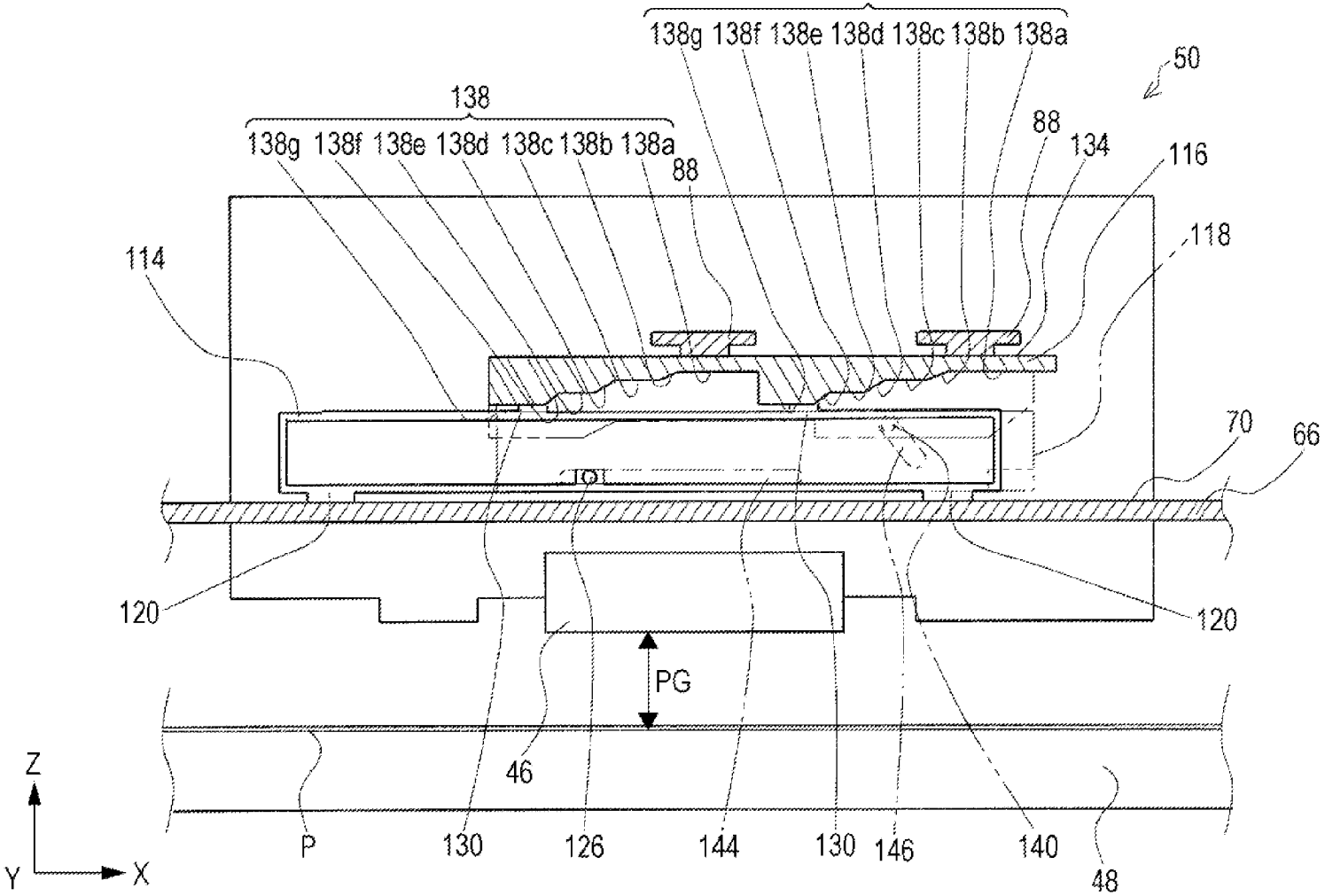
FIG. 13 is an explanatory view of gap adjustment.
Figure 14:
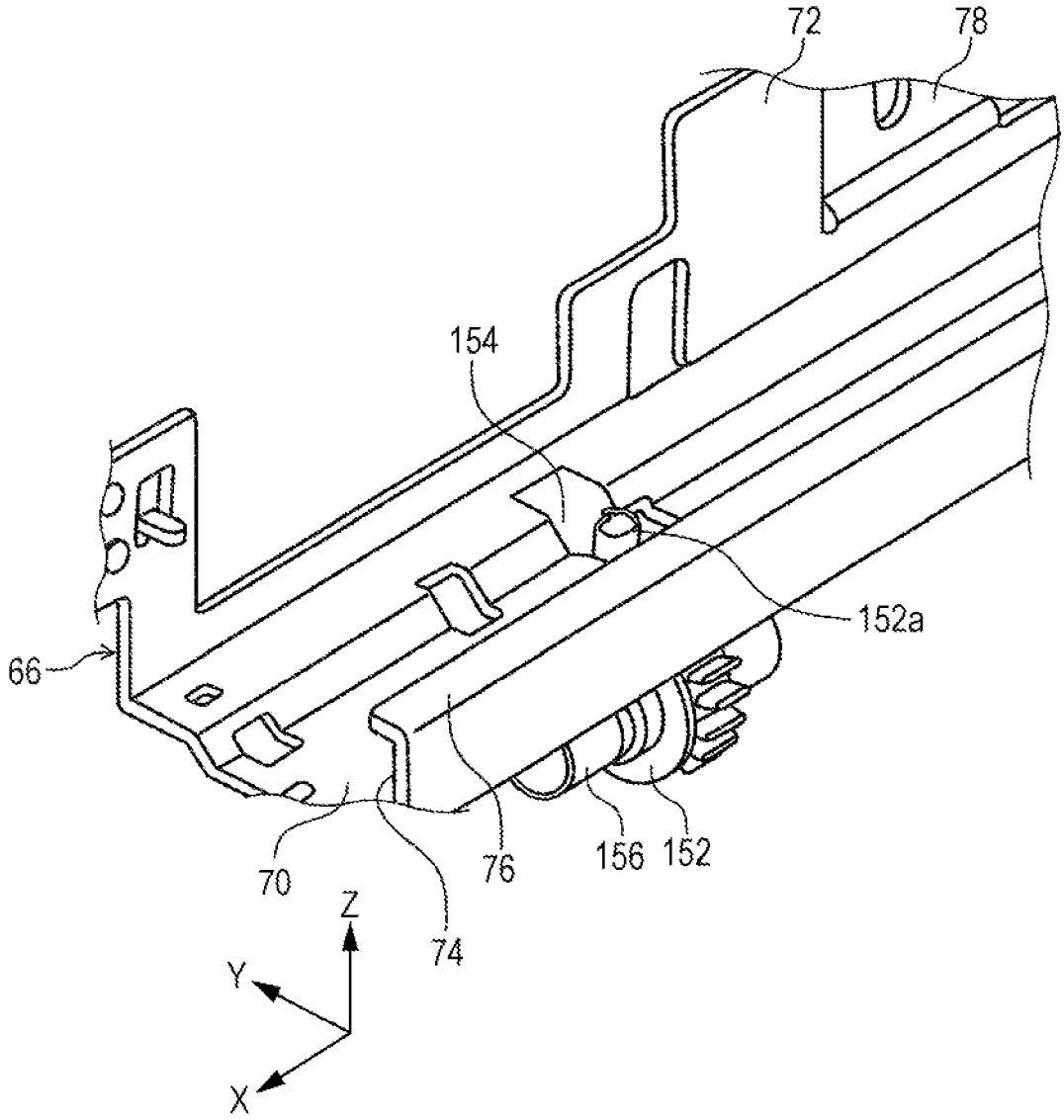
FIG. 14 is a perspective view of a switching lever.
Figure 15A:
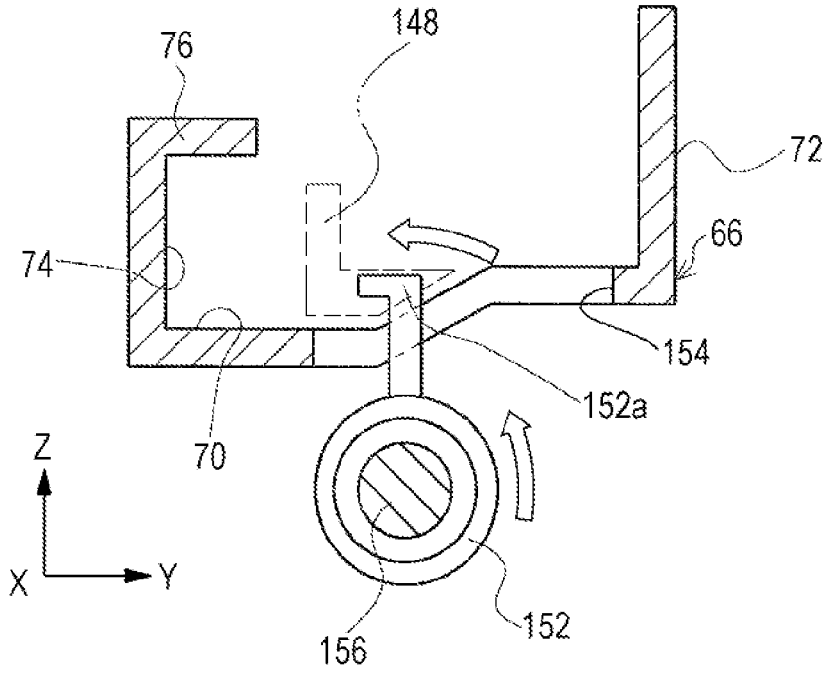
FIG. 15A is an explanatory view showing that the switching lever extends in a movement area of an engagement member.
Figure 15B:
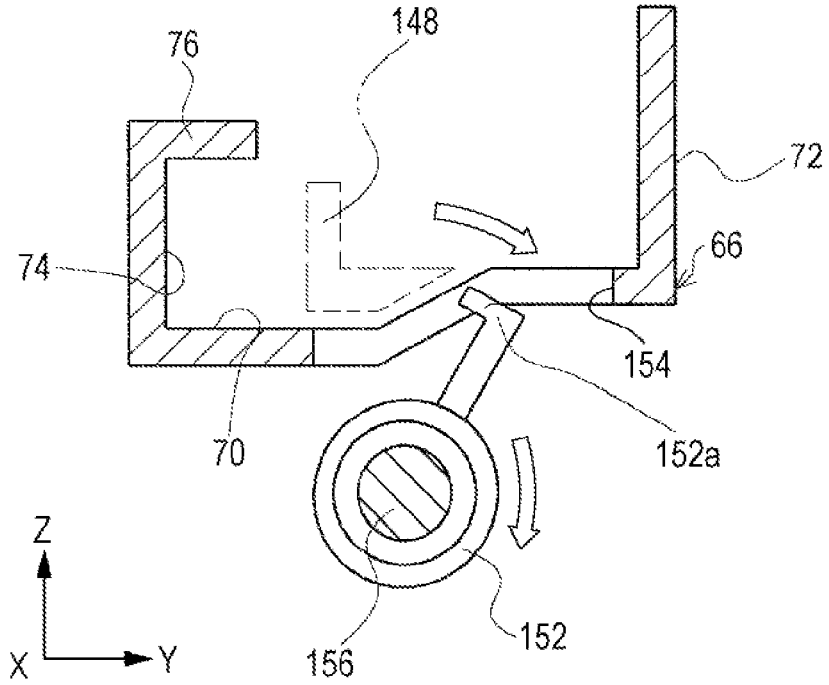
FIG. 15B is an explanatory view showing that the switching lever is retracted in the movement area of the engagement member.

FIGS. 12 and 13 are explanatory views of gap adjustment. FIG. 14 is a perspective view of a switching lever. FIG. 15A is an explanatory view showing that the switching lever extends in a movement area of an engagement member and FIG. 15B is an explanatory view showing that the switching lever is retracted in the movement area of the engagement member.

Figure 16A:
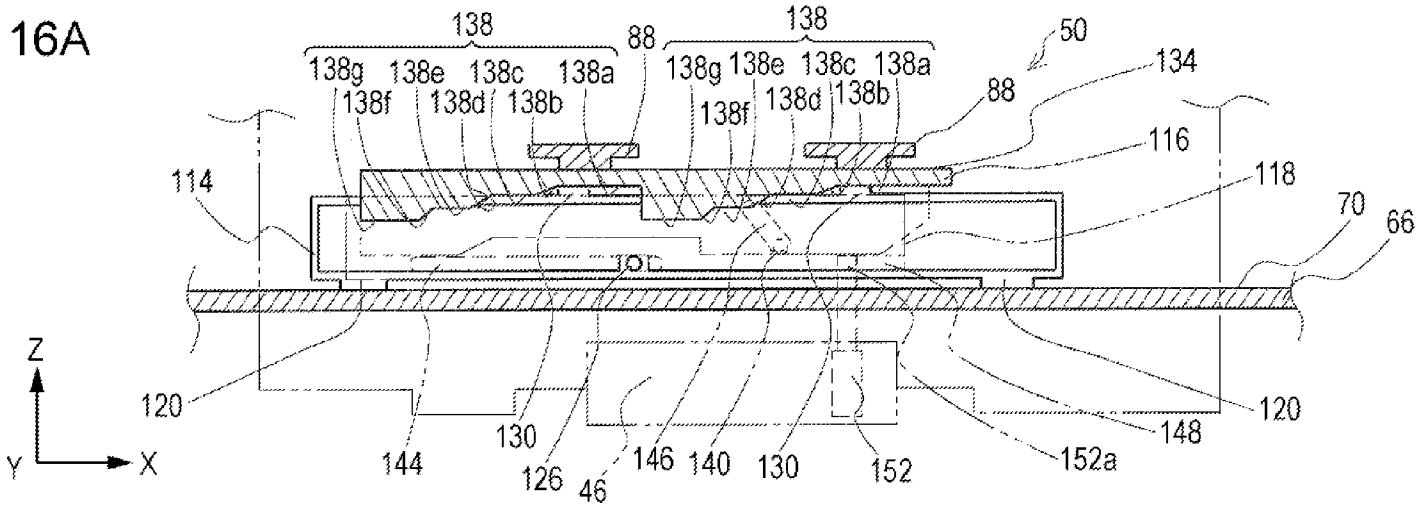
FIGS. 16A and 16B are views which explain an operation to increase the gap.
Figure 16B:
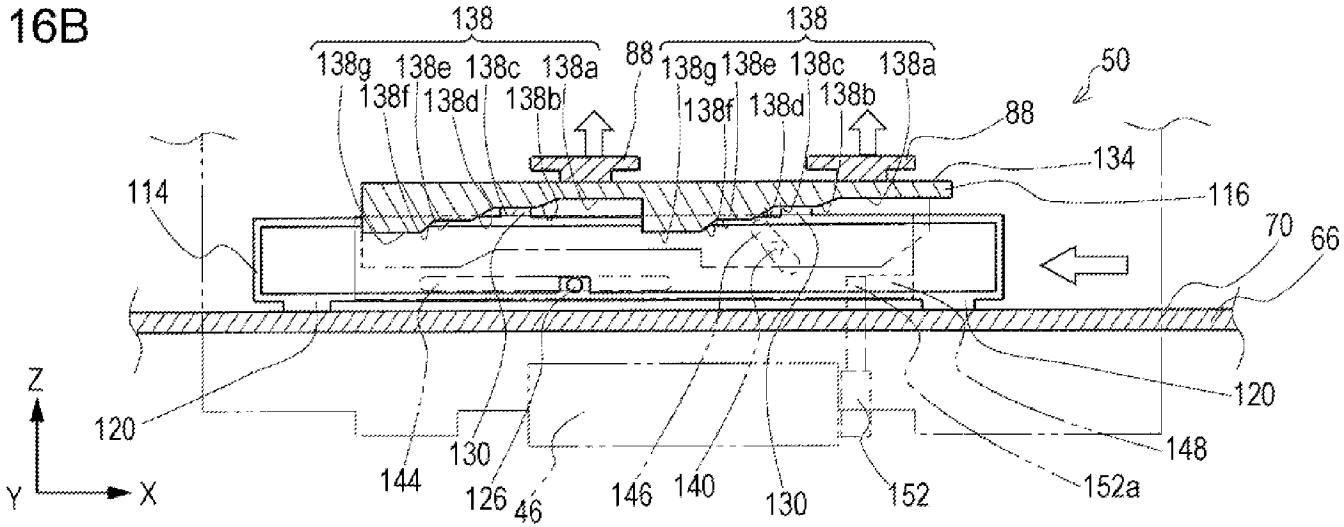
Figure 17A:
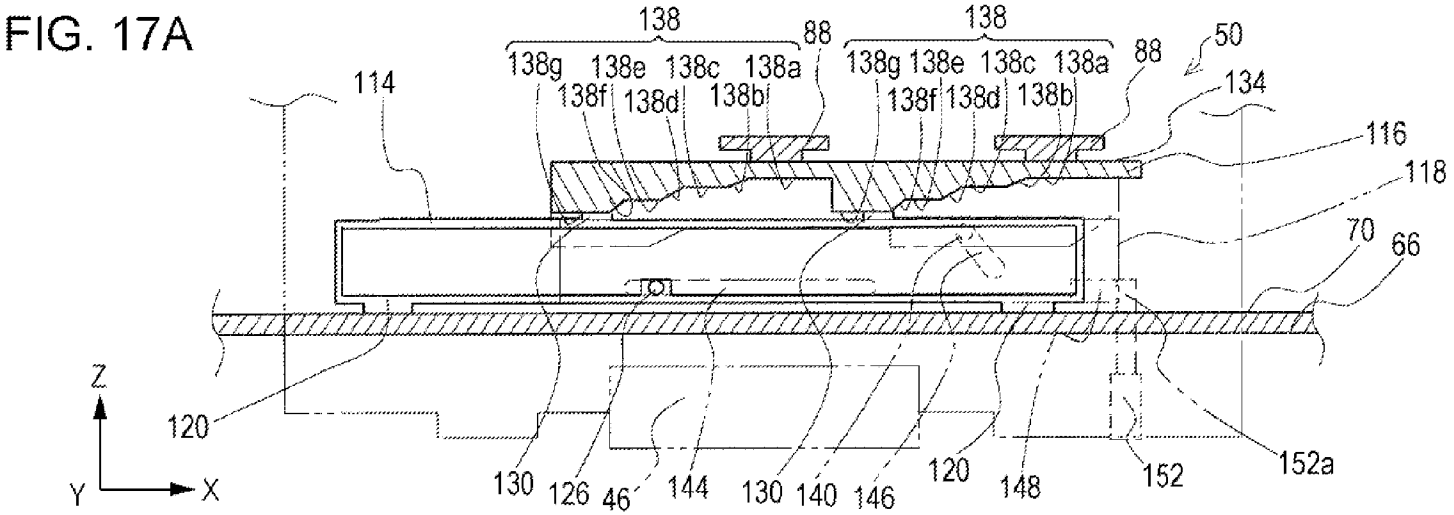
FIGS. 17A and 17B are views which explain an operation to decrease the gap.
Figure 17B:
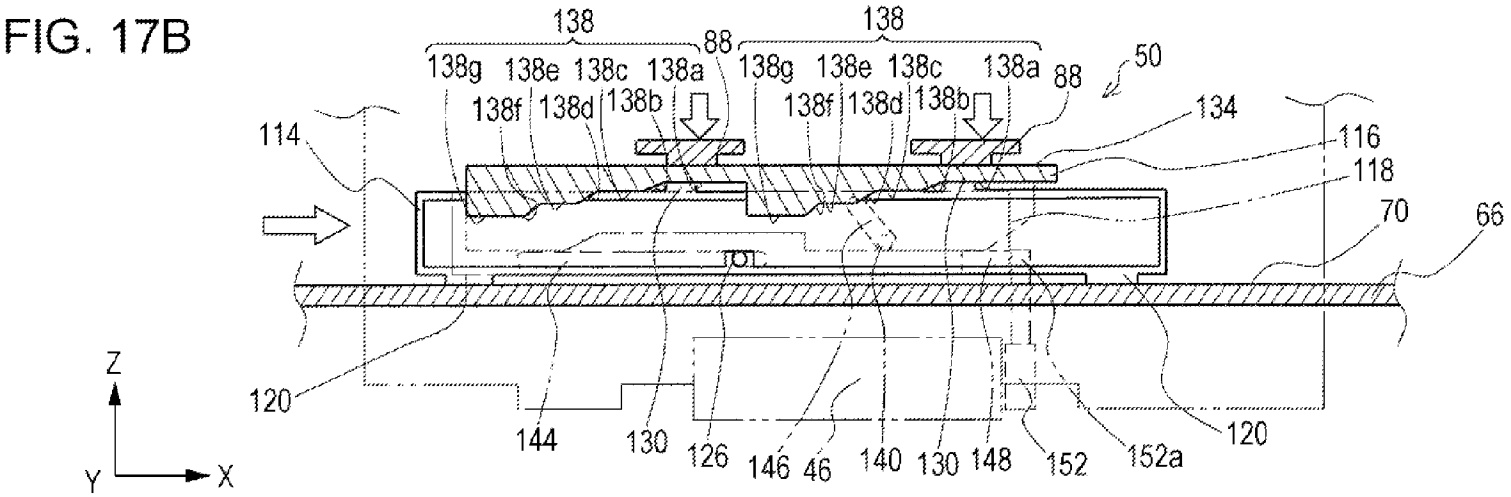
Figure 18A:
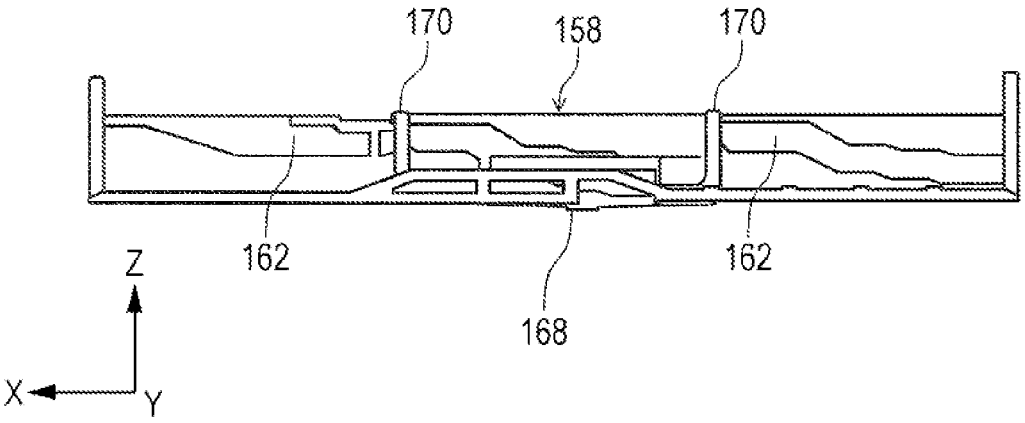
FIG. 18A is a front elevation view of a sliding member of a sub-gap adjusting unit.
Figure 18B:
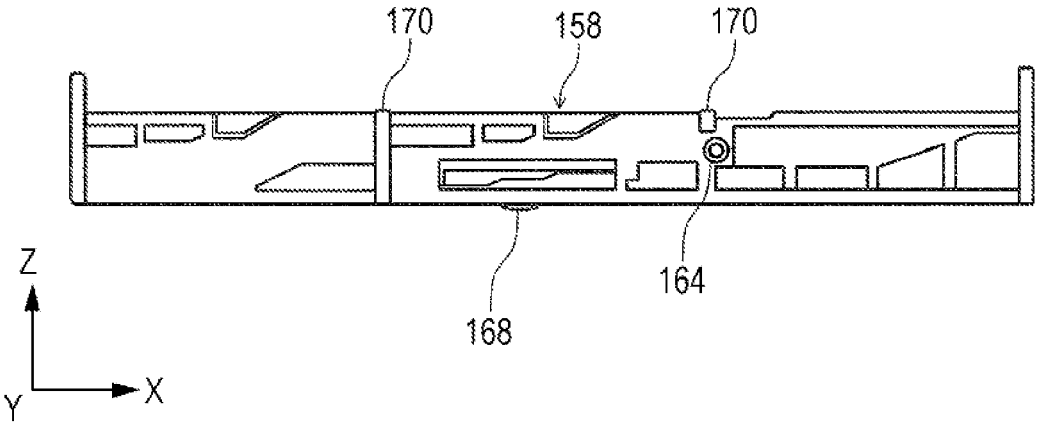
FIG. 18B is a back elevation view of the sliding member of the sub-gap adjusting unit.

FIGS. 16A and 16B are views which explain an operation to increase the gap. FIGS. 17A and 17B are views which explain an operation to decrease the gap. FIG. 18A is a front elevation view of a sliding member of a sub-gap adjusting unit and FIG. 18B is a back elevation view of the sliding member of the sub-gap adjusting unit.

Figure 19A:
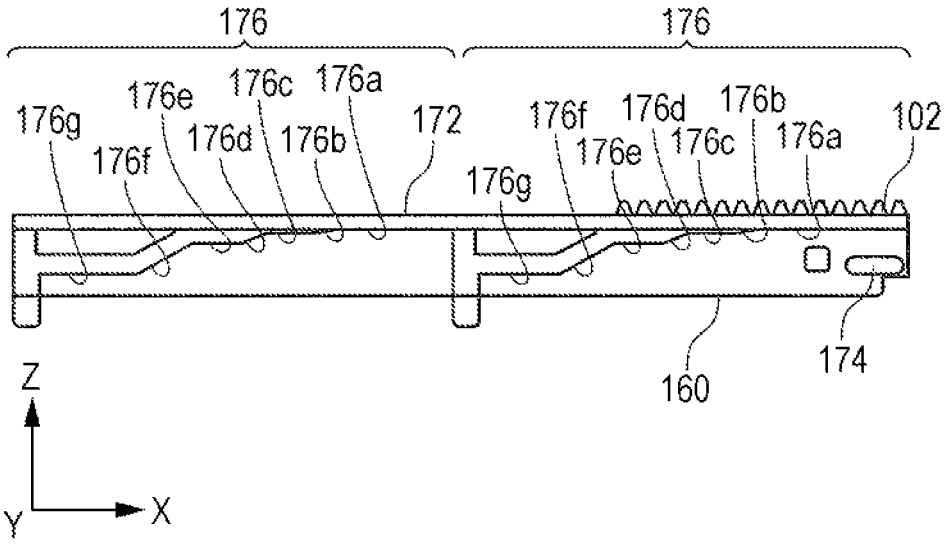
FIG. 19A is a back elevation view of a cam member of the sub-gap adjusting unit.
Figure 19B:
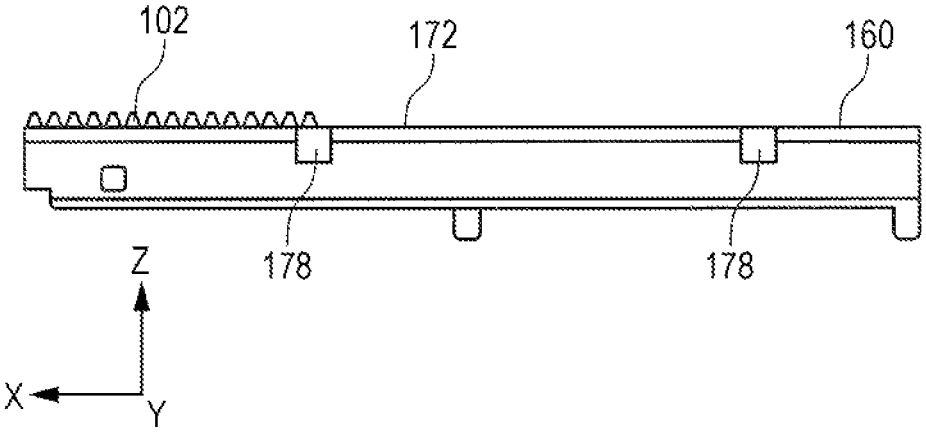
FIG. 19B is a front elevation view of the cam member of the sub-gap adjusting unit.
Figure 20A:
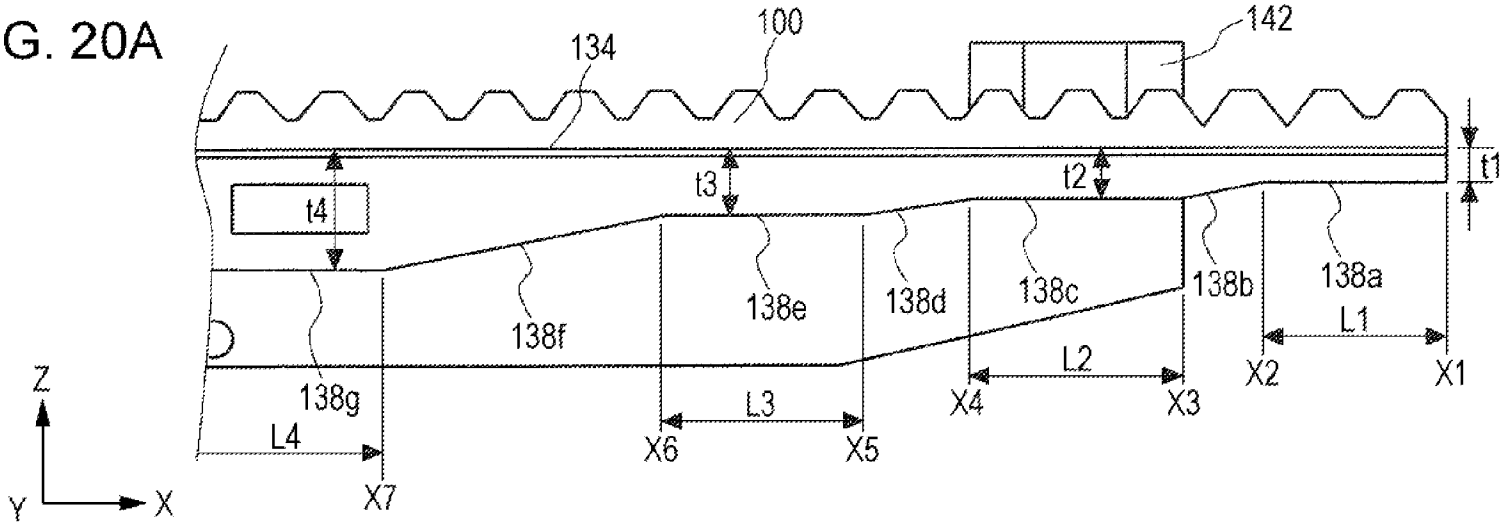
FIG. 20A is an enlarged view of a cam of the cam member of the main gap adjusting unit.
Figure 20B:
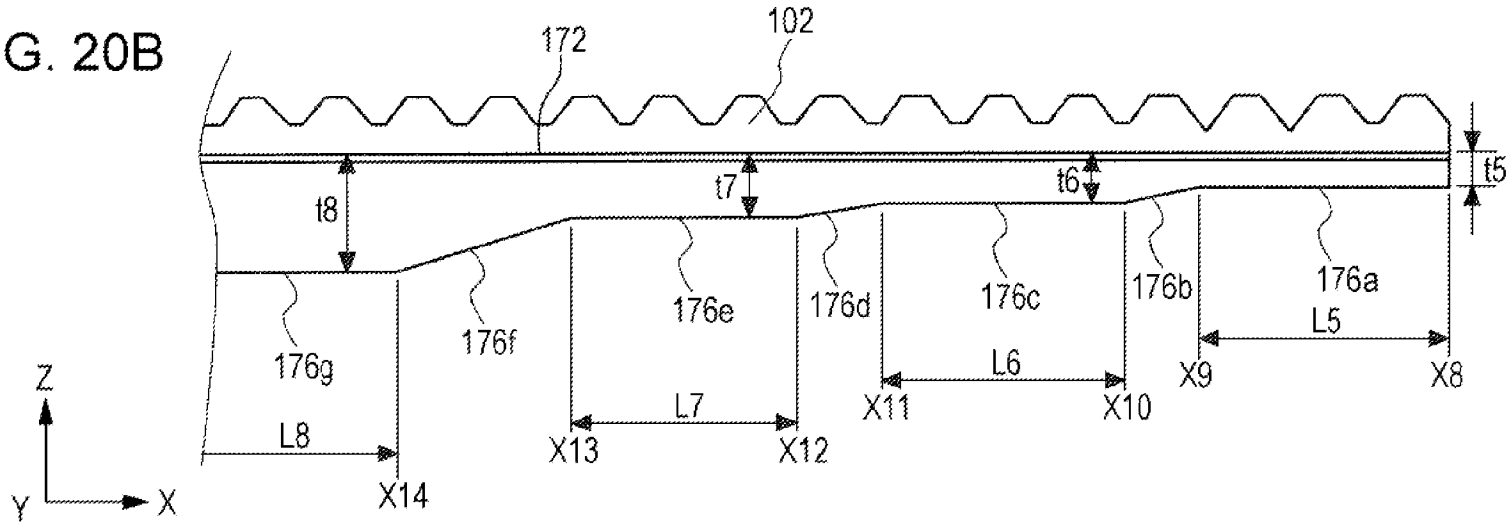
FIG. 20B is an enlarged view of a cam of the cam member of the sub-gap adjusting unit.
Figure 21:
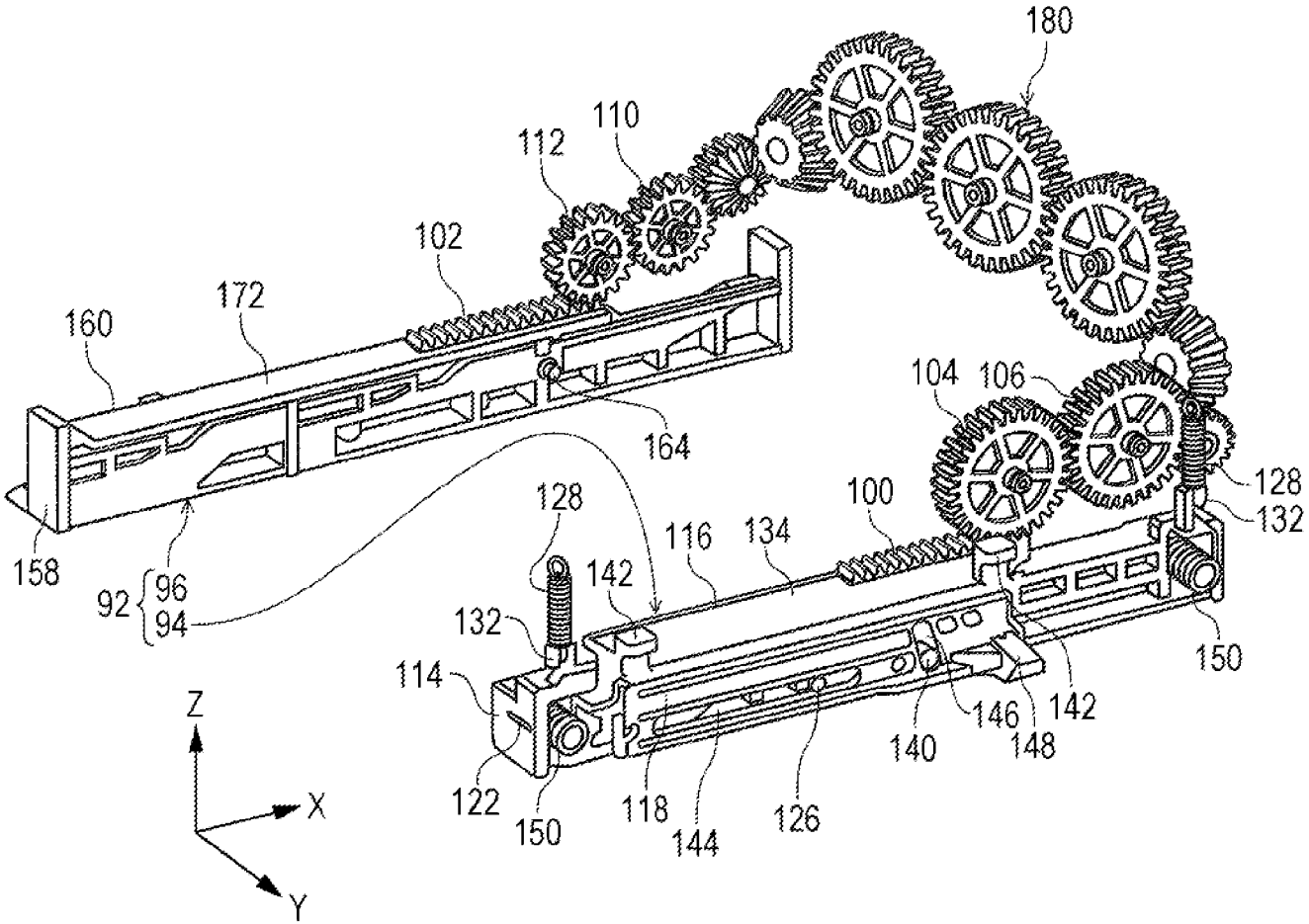
FIG. 21 is a perspective view of a gap adjusting mechanism according to a second embodiment.

FIG. 19A is a back elevation view of a cam member of the sub-gap adjusting unit and FIG. 19B is a front elevation view of the cam member of the sub-gap adjusting unit. FIG. 20A is an enlarged view of a cam of the cam member of the main gap adjusting unit and FIG. 20B is an enlarged view of a cam of the cam member of the sub-gap adjusting unit. FIG. 21 is a perspective view of a gap adjusting mechanism according to a second embodiment.

For purpose of illustrating rollers disposed on the sheet transportation path of the printer 10, FIG. 1 shows most rollers as being located on the same plane. However, the rollers are not necessarily at the same positions (or may be at the same positions) in the depth direction (the direction perpendicular to the plane of FIG. 1). In the X-Y-Z coordinate system shown throughout the figures, the X direction is a scan direction of the recording head, the Y direction is the depth direction of the recording apparatus, and the Z direction is a direction in which the gap varies, that is, the height direction of the apparatus. Throughout the figures, the negative Y direction is defined as a direction that the front side of the apparatus is oriented, while the positive Y direction is defined as a direction that the back side of the apparatus is oriented.

Referring to FIG. 1, the elements on the sheet transportation path will be further described in detail. An apparatus body 12 includes a feeding section 18, a feeding unit 20, a transportation unit 22, a recording unit 24 and an ejecting unit 26. The feeding section 18 is composed of a lower tray 14 that stores paper sheets and an upper tray 16 that is disposed above the lower tray 14 and stores paper sheets as "recording media." The lower tray 14 and the upper tray 16 are removably attached on the apparatus body 12 from the front side of the apparatus. The feeding section 18 further includes a pick-up roller 28 and a separation unit 30.

When driven by a motor, which is not shown in the figure, the upper tray 16 moves in the depth direction of the apparatus (Y axis direction in FIG. 1) between an abutting position, that is, a feedable position (see FIG. 1) and a stand-by position (not shown) which is offset from the abutting position by a predetermined distance in the negative Y direction. In FIG. 1, the paper sheets stored in the lower tray 14 are denoted by reference P1, and the paper sheets stored in the upper tray 16 are denoted by reference P2 (hereinafter, also comprehensively referred to as "paper sheet P"). The paper sheet P is an example of transportation medium.

The pick-up roller 28 is disposed above the upper and lower trays 16 and 14 and rotates by driving a motor, which is not shown in the figure. The pick-up roller 28 is mounted on a swing member 34 that swings about a swing shaft 32. When the upper tray 16 is at the feedable position, the pick-up roller 28 rotates while being in contact with the uppermost paper sheet P2 stored in the upper tray 16 so that the uppermost paper sheet P2 is fed out from the upper tray 16 to the feeding path.

When the upper tray 16 is at the stand-by position, the pick-up roller 28 rotates while being in contact with the uppermost paper sheet P1 stored in the lower tray 14 so that the uppermost paper sheet P1 is fed out from the lower tray 14 to the feeding path.

The separation unit 30 is disposed at a position that opposes the leading edge of the paper sheets P1 stored in the lower tray 14 and the leading edge of the paper sheets P2 stored in the upper tray 16. The separation unit 30 comes into contact with the leading edge of the paper sheets P which are fed out from the lower tray 14 or the upper tray 16 by rotating the pick-up roller 28. Then, when the paper sheets P are transported downstream in the feeding path while being in contact with the separation unit 30, the separation unit 30 separates the uppermost paper sheet P from the subsequent paper sheets P. Accordingly, the feeding unit 20 feeds a sheet material (paper sheet P) which is an example of transportation medium downstream in the feeding path.

The feeding unit 20 is disposed at a position downstream of the separation unit 30 in the feeding path. The feeding unit 20 includes a feeding driving roller 36 that is driven by a motor, which is not shown in the figure, a separation roller 38 and a feeding driven roller 40. The separation roller 38 is in contact with the feeding driving roller 36 in order to assure the separation of the uppermost paper sheet P from the subsequent paper sheets P and feed the uppermost paper sheet P downstream in the feeding path.

The feeding driven roller 40 is disposed at a position downstream of the separation roller 38 and is rotated while cooperating with the feeding driving roller 36 to hold the paper sheet P therebetween. Further, a transportation unit 22 is disposed at a position downstream of the feeding driven roller 40 in the feeding path. The transportation unit 22 is composed of a transportation driving roller 42 that is driven by a motor, which is not shown in the figure, and a transportation driven roller 44 that is rotated by press-contact with the transportation driving roller 42. Accordingly, the transportation unit 22 feeds the paper sheet P further downstream.

A recording unit 24 is disposed at a position downstream of the transportation unit 22. The recording unit 24 includes a recording head 46 and a platen 48 which is a lower guide member that opposes the recording head 46 and serves as a support member that supports the paper sheet P. The recording head 46 is provided on the underside of the carriage 50 so as to oppose the paper sheet P. The carriage 50 is moved by a driving motor, which is not shown in the figure, to reciprocate in a main scan direction (the direction perpendicular to the plane of FIG. 1, that is, the X axis direction).

The lower guide member 48 supports the paper sheet P and defines a distance between the lower guide member 48 and the recording head 46, that is, a gap PG. Further, an ejecting unit 26 is disposed at a position downstream of the lower guide member 48 so as to feed the paper sheet P after recording is performed on the paper sheet P. The ejecting unit 26 includes a first roller 52 that is driven by a drive source, which is not shown in the figure, and a second roller 54 that is rotated by contact with the first roller.

After recording is performed on the paper sheet P by the recording unit 24, the paper sheet P is nipped between the first roller 52 and the second roller 54 and is ejected on an ejected paper stacker 56 which is disposed on the front side of the apparatus body 12 (the right side in FIG. 1). As an operation panel 58 is rotated relative to the apparatus body 12, the ejected paper stacker 56 moves in a direction in which it extends to the outside of the apparatus body 12, that is, the ejected paper stacker 56 is pulled out in the Y axis direction, or the ejected paper stacker 56 moves in a direction in which it is drawn into the apparatus body 12.

Moreover, in the printer 10 that performs double-sided printing on the paper sheet P, after recording is performed on a first side of the paper sheet P by the recording unit 24, the paper sheet P is fed back to the upstream side of the transportation unit 22 by a return operation of the transportation unit 22 and the ejecting unit 26. The tailing edge of the paper sheet P during recording on the first side of the paper sheet P becomes the leading edge when the paper sheet P is fed back. The paper sheet P is further fed to a reversing path 60 by a retuning operation of the transportation unit 22. After being fed to the reversing path 60, the paper sheet P is nipped between the driving roller 36 and a reversing roller 62 and is fed back to the feeding path.

The paper sheet P is then fed back to the transportation unit 22 downstream in the feeding path by the driving roller 36 through the separation roller 38 and the driven roller 40. The paper sheet P is turned and reversed so that a second side of the paper sheet P instead of the first side is oriented to the recording head 46. The paper sheet P is fed to the recording unit 24 by the transportation unit 22. After recording is performed on the second side of the paper sheet P by the recording unit 24, the paper sheet P is nipped in the ejecting unit 26 and is ejected on the ejected paper stacker 56 which is disposed on the front side of the apparatus body 12.

First Embodiment

Referring to FIGS. 2 and 3, the recording unit 24 according to a first embodiment of the invention will be described in detail. The carriage 50 of the recording unit 24 is guided by a pair of guide rails 64 which is a "guide member" that extends in the scan direction (X axis direction in FIG. 2) of the recording head 46 so as to move in the scan direction. The pair of guide rails 64 includes a main guide rail 66 which is a "first guide member" disposed at a back position, that is, a position in the positive Y direction in the apparatus body 12, and a sub-guide rail 68 which is a "second guide member" disposed at a front position, that is, a position in the negative Y direction in the apparatus body 12.

Referring to FIGS. 4A and 4B, the main guide rail 66 includes a sliding surface 70, a supporting surface 72 that extends in the Z direction from the back end (the end located in the positive Y direction) of the sliding surface 70, a guiding surface 74 which is a "wall" that extends in the Z direction from the front end (the end located in the negative Y direction) of the sliding surface 70, and a regulation section 76 that extends from the upper end of the guiding surface 74 toward the back side of the apparatus (in the Y direction) so as to oppose the sliding surface 70.

A plurality of mounting sections 78 are provided on the supporting surface 72 of the main guide rail 66 at intervals with each other in the scan direction. The main guide rail 66 is mounted by means of screws or the like with the mounting sections 78 being in contact with a frame 79 of the apparatus body 12. The mounting sections 78 each have a flat surface 80. The flat surfaces 80 have a large area on the supporting surface 72 so as to reduce or prevent tilting of the main guide rail 66 in the height direction of the apparatus or distortion of the main guide rail 66 in the scan direction.

Referring again to FIG. 3, the sub-guide rail 68 includes a sliding surface 82, a wall 84 that extends in the Z direction from the front end (the end located in the negative Y direction) of the sliding surface 82, and a plurality of eave portions 86 that extends from the wall 84 toward the carriage 50 at intervals with each other in the scan direction.

As the carriage 50 moves in the scan direction, the eave portions 86 engage a front face of the carriage 50 and prevent the carriage 50 from being lifted in the Z direction. Accordingly, when paper jam occurs in the printer 10, the carriage 50 is not lifted and displaced upward in the positive Z direction due to the jammed paper sheets. Printing can be promptly resumed by removing the jammed paper sheets from the printer 10.

Referring FIGS. 5A, 5B and 6, there is shown the carriage 50 according to the first embodiment. The carriage 50 includes a housing 88, an ink cartridge container 90 that is disposed in the upper portion of the housing 88 and houses a plurality of ink cartridges, a recording head 46 that is disposed in an opening in the lower portion of the housing 88 and opposes the lower guide member 48, and a gap adjusting unit 92 that adjust a gap PG between the recording head 46 and the lower guide member 48 which supports the paper sheet P.

The gap adjusting unit 92 that adjust the gap between the recording head 46 and the lower guide member 48, that is, the gap PG is disposed on the front side (the side in the negative Y direction in FIG. 5A) and the back side (the side in the positive Y direction in FIG. 5B) of the housing 88. The gap adjusting unit 92, which will be described later in detail, includes a main gap adjusting unit 94 which is a "first gap adjusting unit" disposed at a back position in the housing 88 (the right side in FIG. 6), and a sub-gap adjusting unit 96 which is a "second gap adjusting unit" disposed at a front position in the housing (the left side in FIG. 6).

The main gap adjusting unit 94 which is disposed at a back position in the housing 88 abuts against the sliding surface 70 of the main guide rail 66 and is supported by the main guide rail 66. The sub-gap adjusting unit 96 which is disposed at a front position in the housing 88 abuts against the sliding surface 82 of the sub-guide rail 68 and is supported by the sub-guide rail 68. The carriage 50 can move in the scan direction by sliding the main gap adjusting unit 94 and the sub-gap adjusting unit 96 toward the sliding surface 70 and the sliding surface 82, respectively.

Further, in accordance with the distance between the main guide rail 66 and the sub-guide rail 68 increases, the length of the carriage 50, and thus the length of the ink cartridge container 90, in the direction perpendicular to the scan direction increases. Accordingly, regardless of the carriage being reduced in size in the height direction, the ink volume of the ink cartridges can remain the same.

The recording head 46 is disposed on the underside of the housing 88 of the carriage 50 at a position close to the main gap adjusting unit 94 in the Y axis direction (see FIG. 6). In assembling the printer 10, it is necessary to adjust the gap PG. Generally, adjusting the gap PG by moving one of the main guide rail 66 and the sub-guide rail 68 in the Z axis direction causes a problem that the recording head 46 tilts relative to the paper sheet P that is supported by the lower guide member 48, leading to a decrease in precision of printing on the paper sheet P. As a consequence, it has been necessary to adjust the gap PG by moving both the main guide rail 66 and the sub-guide rail 68 in the Z axis direction.

In this embodiment, since a large gap is provided between the main guide rail 66 and the sub-guide rail 68, and the recording head 46 is disposed at a position close to the main gap adjusting unit 94, tilt of the recording head 46 caused by adjusting the gap PG by moving the main guide rail 66 in the Z axis direction is so small that it has little effect on precision of printing on the paper sheet P. Accordingly, in this embodiment, the gap PG can be adjusted without moving the sub-guide rail 68 in the Z axis direction, resulting in simplified assembling process.

Referring to FIG. 7, the gap adjusting unit 92 will be further described in detail. The gap adjusting unit 92 includes the main gap adjusting unit 94 that is disposed at a back position in the housing 88 of the carriage 50, and the sub-gap adjusting unit 96 that is disposed at a front position in the housing 88 of the carriage 50, and a synchronizing unit 98 that synchronizes the main gap adjusting unit 94 and the sub-gap adjusting unit 96.

The main gap adjusting unit 94 includes a rack 100 that extends in the scan direction (the X axis direction in FIG. 7) and is movable in the scan direction, while the sub-gap adjusting unit 96 includes a rack 102 that extends in the scan direction and is movable in the scan direction.

The synchronizing unit 98 includes a first transmission gear 104 that engages the rack 100, a second transmission gear 106 that engages the first transmission gear 104, a pinion gear shaft 108 that engages the second transmission gear 106 and extends between the main gap adjusting unit 94 and the sub-gap adjusting unit 96, a third transmission gear 110 that engages the pinion gear shaft 108, and a fourth transmission gear 112 that engages the third transmission gear 110 and the rack 102. That is, one end of the synchronizing unit 98 engages the main gap adjusting unit 94, while the other end of the synchronizing unit 98 engages the sub-gap adjusting unit 96.

In the synchronizing unit 98, as the rack 100 moves in the scan direction, a linear movement of the rack 100 is converted by the first transmission gear 104 into a rotational movement, and the rotational movement is transmitted to the rack 102 by the fourth transmission gear 112 as a linear movement via the second transmission gear 106, the pinion gear shaft 108 and the third transmission gear 110. That is, the synchronizing unit 98 synchronizes the rack 102 to move in the same direction as the direction in which the rack 100 moves.

Since the synchronizing unit 98 is configured to connect the main gap adjusting unit 94 and the sub-gap adjusting unit 96 via a mechanism such as a plurality of gears, a force that displaces the housing 88 of the main gap adjusting unit 94 can be transmitted to the sub-gap adjusting unit 96 when the main gap adjusting unit 94 displaces the housing 88 of the carriage 50 in the direction in which the gap PG varies.

Referring to FIG. 8A, there is shown the main gap adjusting unit 94. The main gap adjusting unit 94 includes a sliding member 114 which is a "first sliding member" that abuts against the main guide rail 66 and slides relative to the main guide rail 66, and a cam member 116 which is a "first cam member" that engages the sliding member 114, and an engagement member 118 that engages the cam member 116.

The sliding member 114 extends in the X axis direction as shown in FIG. 8B. Sliding sections 120 (see FIG. 6) are disposed on the underside (the side in the negative Z direction in FIG. 8B) of the sliding member 114 at each end in the X axis direction so as to abut against the sliding surface 70 of the main guide rail 66. Further, regulation sections 122 are disposed on the sliding member 114 at each end in the X axis direction so as to abut against the housing 88 of the carriage 50 and regulate a movement of the main gap adjusting unit 94 in the X axis direction relative to the housing 88.

Further, engagement sections 124 are disposed on one side of the sliding member 114 in the Y axis direction (the side in the positive Y direction in FIG. 8B) so as to engage the cam member 116. The engagement sections 124 are formed in a stepped shape which corresponds to the shape of cam sections 138 of the cam member 116, which will be described later. A guide pin 126 is also disposed on the one side of the sliding member 114 so as to guide the engagement member 118.

A plurality of contact sections 130 are disposed on the top of the sliding member 114 so as to come into contact with the cam sections 138 of the cam member 116. Further, hook sections 132 are disposed on the top of the sliding member 114 at each end of in the X axis direction so as to lock the first spring members 128 which are first bias members, which will be described later.

Referring to FIG. 9A and FIG. 9B, there is shown the cam member 116. The rack 100 is disposed on the top of the cam member 116. The top of the cam member 116 abuts against the housing 88 of the carriage 50 and serves as a supporting surface 134 that supports the housing 88. First engagement pins 136 are disposed on one side of the cam member 116 in the Y axis direction (see FIG. 9B) so as to engage the engagement sections 124 of the sliding member 114.

Further, the cam sections 138 having a stepped shape are disposed on the one side of the cam member 116. The cam sections 138 each include a first stepped portion 138*a*, a second stepped portion 138*c*, a third stepped portion 138*e*, a fourth stepped portion 138*g* which serve as "gap holding surfaces," and a first inclined section 138*b*, a second inclined section 138*d*, a third inclined section 138*f* which serve as "gap adjusting surfaces."

The gap PG is defined and maintained by engaging one of the first stepped portions 138*a*, the second stepped portions 138*c*, the third stepped portions 138*e* and the fourth stepped portions 138*g* with the contact sections 130 of the sliding member 114. When the cam member 116 slides relative to the sliding member 114, the gap PG is varied by the first inclined sections 138*b*, the second inclined sections 138*d* and the third inclined sections 138*f*. In the cam sections 138, the stepped portions 138*a*, 138*c*, 138*e*, 138*g* and the inclined sections 138*b*, 138*d*, 138*f* are alternatively disposed to form a stepped shape.

A second engagement pin 140 which is a "projection" is disposed on the other side of the cam member 116 in the Y axis direction (the side in the positive Y direction in FIG. 9A) to engage the engagement member 118. Further, engagement sections 142 are also disposed on the other side of the cam member 116 so as to engage the housing 88 of the carriage 50.

FIG. 10 shows the engagement member 118. The engagement member 118 is formed as a plate member that extends in the X axis direction. A guiding recess 144 that extends in the X axis direction is formed on the engagement member 118. The guide pin 126 of the sliding member 114 is loosely inserted into the guiding recess 144 and guides the engagement member 118. Further, an elongated hole 146 is formed on the engagement member 118 so that the second engagement pin 140 of the cam member 116 is inserted into the elongated hole 146.

The elongated hole 146 extends in the Z axis direction and is also angled in the X axis direction. While the engagement member 118 slides, the second engagement pin 140 in the elongated hole 146 is guided to move in an appropriate direction in the X axis direction since the elongated hole 146 is inclined by a predetermined angle relative to the Z axis direction, that is, the direction in which the gap PG varies. Further, a protruding section 148 is disposed on a surface of the engagement member 118 (the surface in the positive Y direction in FIG. 10) which is opposite in the Y axis direction to a surface of the engagement member 118 which engages the cam member 116 (the surface in the negative Y direction in FIG. 10).

The protruding section 148 extends in the positive Y direction (see FIG. 10) from the surface of the engagement member 118. In this embodiment, the protruding section 148 is provided on the lower end of the engagement member 118 in the Z axis direction in order to reduce a swing radius of a switching lever 152, which will be described later. The engagement member 118 is configured to slide in the X axis direction, that is, the scan direction, and not in the Z axis direction during sliding relative to the sliding member 114. Accordingly, the protruding section 148 is configured to displace in the X axis direction and not in the Z axis direction.

The protruding section 148 remains at a constant position in the direction in which the gap PG varies. Accordingly, the size of the protruding section 148 which abuts against a distal end 152*a* of the switching lever 152, which will be described later, in the direction in which the gap PG varies and the size of the distal end 152*a* in the direction in which the gap PG varies can be reduced.

With reference to FIG. 11, the relationship among the sliding member 114, the cam member 116 and the engagement member 118 in the main gap adjusting unit 94 will be described below. FIG. 11 is a sectional view of the main gap adjusting unit 94 of FIG. 8A in the Y axis direction.

The sliding member 114 is positioned in an area surrounded by the sliding surface 70, the guiding surface 74 and the regulation section 76 of the main guide rail 66. Accordingly, the relative displacement of the sliding member 114 to the main guide rail 66 in the Z axis direction is regulated. The sliding surface 70 is in sliding contact with the sliding section 120 of the sliding member 114.

As shown in FIG. 8A, the second spring members 150 which are "second bias members" are disposed on each end of the sliding member 114 in the X axis direction. The second spring members 150 are positioned between the sliding member 114 and the housing 88 of the carriage 50, and bias the sliding member 114 to the guiding surface 74 by a biasing force. As a consequence, when the sliding member 114 slides relative to the main guide rail 66 in the scan direction, that is, in the X axis direction, the sliding member 114 can be prevented from being rattled in the Y axis direction.

The first engagement pins 136 on the cam member 116 are received in the engagement sections 124 of the sliding member 114. When the cam member 116 slides relative to the sliding member 114 along the shape of the cam sections 138, the engagement sections 124 allow the cam member 116 to be displaced in the X axis direction and the Z axis direction along the shape of the cam sections 138, and regulates the cam member 116 so as not to be displace only in the Z axis direction away from the shape of the cam sections 138.

One end of the first spring members 128 is hooked on the hook sections 132 of the sliding member 114, while the other end of the first spring members 128 is attached on the housing 88 of the carriage 50. The cam member 116 is biased to the housing 88 by a biasing force of the first spring members 128 via the sliding member 114. Accordingly, a rattling between the sliding member 114 and the housing 88 in the Z axis direction can be reduced.

Since the sliding member 114 is forced against the sliding surface 70 of the main guide rail 66 by the weight of the carriage 50, the sliding surface 70 is suppressed or prevented from being lifted upward from the carriage 50 when the carriage 50 moves in the scan direction.

The engagement sections 142 of the cam member 116 engage part of the housing 88 of the carriage 50 and regulate the displacement of the cam member 116 in the Z axis direction so that the cam member 116 is not removed from the housing 88. The engagement member 118 is positioned between the cam member 116 and the housing 88 and is slidingly movable in the X axis direction with the cam member 116.

With reference to FIGS. 12 and 13, the gap PG will be described later. FIG. 12 shows that the first stepped portions 138*a* of the cam sections 138 of the cam member 116 is in contact with the contact sections 130 of the sliding member 114. With this thickness of the first stepped portions 138*a* in the Z axis direction, the gap PG between the lower guide member 48 that supports the paper sheet P and the recording head 46 of the carriage 50 is minimum.

FIG. 13 shows that the fourth stepped portions 138*g* of the cam sections 138 of the cam member 116 is in contact with the contact sections 130 of the sliding member 114. With this thickness of the fourth stepped portions 138*g* in the Z axis direction, the gap PG between the lower guide member 48 that supports the paper sheet P and the recording head 46 of the carriage 50 is maximum.

When the engagement member 118 slides relative to the sliding member 114 in the X axis direction, the second engagement pin 140 which is loosely inserted in the elongated hole 146 of the cam member 116 is guided along the elongated hole 146. As a result, the cam member 116 slides relative to the sliding member 114 in the X axis direction as well as in the Z axis direction. As the cam member 116 slides, the contact sections 130 of the sliding member 114 engage the first stepped portions 138*a*, the first inclined sections 138*b*, the second stepped portions 138*c*, the second inclined sections 138*d*, the third stepped portion 138*e*, the third inclined section 138*f*, the fourth stepped portion 138*g* of the cam sections 138 of the cam member 116 in sequence.

That is, when the cam member 116 slides relative to the sliding member 114 in the X direction, the contact sections 130 engage the stepped portions 138*a*, 138*c*, 138*e*, 138*g* in sequence, or when the cam member 116 slides relative to the sliding member 114 in the negative X direction, the contact section 130 engage the stepped portions 138*g*, 138*e*, 138*c*, 138*a* in sequence, thereby changing the distance of the gap PG.

With reference to FIGS. 14 through 17, a switching unit of the main gap adjusting unit 94 and a switching method of the gap PG will be described. FIG. 14 shows the switching lever 152 which is a "switching member". The switching lever 152 is disposed in the proximity of one end of a movement area of the carriage 50 in the X axis direction (for example, the end (on the 80-digit side) which is opposite of a home position of the carriage 50). An opening 154 is formed on the main guide rail 66 so as to correspond to the position of the switching lever 152. The switching lever 152 is mounted on the swing shaft 156 and is configured to swing about the swing shaft 156 by a driving source, which is not shown in the figure.

FIGS. 15A and 15B show the swinging of the switching lever 152. FIG. 15A shows that the switching lever 152 swings counterclockwise about the swing shaft 156 and that the distal end 152*a* of the switching lever 152 extends to the movement area of the main gap adjusting unit 94 through the opening 154. The distal end 152*a* of the switching lever 152 can engage the protruding section 148 of the engagement member 118 of the main gap adjusting unit 94 which moves in the X axis direction.

Since the protruding section 148 is positioned on the lower end of the engagement member 118, the distance from the swing shaft 156 to the distal end 152*a* of the switching lever 152 can be reduced. Accordingly, the swing radius of the switching lever 152 can be reduced and the opening 154 of the main guide rail 66 can be reduced in size.

FIG. 15B shows that the switching lever 152 swings clockwise about the swing shaft 156 and that the distal end 152*a* of the switching lever 152 is retracted from the movement area of the main gap adjusting unit 94. The distal end 152*a* of the switching lever 152 is not in contact with the protruding section 148 of the engagement member 118 of the main gap adjusting unit 94 that moves in the X axis direction.

With reference to FIGS. 16A and 16B, an operation to increase the gap PG between the recording head 46 and the lower guide member 48 that supports the paper sheet P will be described. FIG. 16A shows a state before the gap PG is increased, while the FIG. 16B shows a state that the gap PG has been increased. As shown in FIG. 16A, before feeding of the paper sheet P, the carriage 50 is moved to one end in the X axis direction in which the switching lever 152 is provided (the negative X direction in FIG. 16A).

The carriage 50 is moved until the protruding section 148 of the engagement member 118 comes to a position on the right side of the switching lever 152 in FIG. 16A. Then, the switching lever 152 is turned so that the distal end 152*a* of the switching lever 152 extends to the movement area of the main gap adjusting unit 94 as shown in FIG. 15A. That is, the distal end 152*a* of the switching lever 152 is ready to abut against the protruding section 148 of the engagement member 118.

Then, the carriage 50 is moved in the negative X direction as shown in FIG. 16B. The cam member 116 and the engagement member 118 are prevented from moving with the carriage 50 in the negative X direction since the distal end 152*a* of the switching lever 152 abuts against the protruding section 148 of the engagement member 118, thereby blocking the cam member 116 and the engagement member 118 from further moving in the negative X direction.

Accordingly, the cam member 116 and the engagement member 118 move in the X direction relative to the carriage 50. Then, the cam member 116 can be in contact with the contact sections 130 of the sliding member 114 at different positions instead of the first stepped portions 138*a*, for example, any of the second stepped portions 138*c*, the third stepped portions 138*e* and the fourth stepped portions 138*g*. FIG. 16B shows an example that the cam member 116 is in contact with the second stepped portions 138*c*.

After the carriage 50 stops, the switching lever 152 is turned so that the distal end 152*a* of the switching lever 152 is retracted from the movement area of the main gap adjusting unit 94 as shown in FIG. 15B. As a result, the distance between the supporting surface 134 that supports the housing 88 of the carriage 50 and the contact section 130 can be increased, thereby increasing the gap PG between the recording head 46 and the lower guide member 48 that supports the paper sheet P.

Further, a change from the first stepped portions 138*a* to any of the second stepped portions 138*c*, the third stepped portions 138*e* and the fourth stepped portions 138*g* can be performed by controlling the movement amount of the carriage 50. Although a change from the first stepped portions 138*a* to any of the second stepped portions 138*c*, the third stepped portions 138*e* and the fourth stepped portions 138*g* is described above as an example, a change from the second stepped portions 138*c* to the third stepped portions 138*e* or the fourth stepped portions 138*g*, or a change from the third stepped portions 138*e* to the fourth stepped portions 138*g* is also possible. Since such change is performed by the same operation as that is described above, the detailed description will not be described further. In the above explanation, the distal end 152*a* of the switching lever 152 engages the protruding section 148 at a position inside the housing 88 of the carriage 50 in the scan direction (X axis direction).

With reference to FIGS. 17A and 17B, an operation to decrease the gap PG between the recording head 46 and the lower guide member 48 that supports the paper sheet P will be described. FIG. 17A shows a state before the gap PG is decreased, while the FIG. 17B shows a state that the gap PG has been decreased. As shown in FIG. 17A, before feeding of the paper sheet P, the carriage 50 is moved to one end in the X axis direction in which the switching lever 152 is provided (the X direction in FIG. 17A).

The carriage 50 is moved until the protruding section 148 of the engagement member 118 comes to a position on the left side of the switching lever 152 in FIG. 17A. Then, the switching lever 152 is turned so that the distal end 152*a* of the switching lever 152 extends to the movement area of the main gap adjusting unit 94 as shown in FIG. 15A.

Then, the carriage 50 is moved in the X direction as shown in FIG. 17B. The cam member 116 and the engagement member 118 are prevented from moving with the carriage 50 in the X direction since the distal end 152*a* of the switching lever 152 abuts against the protruding section 148 of the engagement member 118, thereby blocking the cam member 116 and the engagement member 118 from further moving in the X direction.

Accordingly, the cam member 116 and the engagement member 118 move in the negative X direction relative to the carriage 50. Then, the cam member 116 can be in contact with the contact sections 130 of the sliding member 114 at different positions instead of the fourth stepped portion 138*g*, for example, any of the first stepped portions 138*a*, the second stepped portions 138*c* and the third stepped portions 138*e*. FIG. 17B shows an example that the cam member 116 is in contact with the first stepped portions 138*a*.

After the carriage 50 stops, the switching lever 152 is turned so that the distal end 152*a* of the switching lever 152 is retracted from the movement area of the main gap adjusting unit 94 as shown in FIG. 15B. As a result, the distance between the supporting surface 134 that supports the housing 88 of the carriage 50 and the contact section 130 can be decreased, thereby decreasing the gap PG between the recording head 46 and the lower guide member 48 that supports the paper sheet P.

Further, a change from the fourth stepped portions 138*g* to any of the first stepped portions 138*a*, the second stepped portions 138*c* and the third stepped portions 138*e* can be performed by controlling the movement amount of the carriage 50. Although a change from the fourth stepped portions 138*g* to any of the first stepped portions 138*a*, the second stepped portions 138*c* and the third stepped portions 138*e* is described above as an example, a change from the third stepped portions 138*e* to the second stepped portions 138*c* or the first stepped portions 138*a*, or a change from the second stepped portions 138*c* to the first stepped portions 138*a* is also possible. Since such change is performed by the same operation as that is described above, the detailed description will not be described further. In the above explanation, the distal end 152*a* of the switching lever 152 engages the protruding section 148 at a position inside the housing 88 of the carriage 50 in the scan direction (X axis direction).

The sub-gap adjusting unit 96 shown in FIG. 7 will be described below. The sub-gap adjusting unit 96 includes a sliding member 158 which is a "second sliding member" disposed at a front position in the housing 88 of the carriage 50, and a cam member 160 which is a "second cam member" where the movement of the main gap adjusting unit 94 is transmitted by the synchronizing unit 98. The cam member 160 is configured to engage the sliding member 158. The sub-gap adjusting unit 96 differs from the main gap adjusting unit 94 in that it does not have an engagement member.

With reference to FIGS. 18A and 18B, the sliding member 158 will be descried. Engagement sections 162 are disposed on one side of the sliding member 158 in the Y axis direction (see FIG. 18A) so as to engage the cam member 160. Further, a regulation pin 164 is disposed on the other side of the sliding member 158 in the Y axis direction (see FIG. 18B) so as to regulate the relative displacement of the sliding member 158 to the housing 88 in the X axis direction. The regulation pin 164 engages a regulation section 166 disposed on the underside of the housing 88 of the carriage 50 at a position close to the front side (the left side in FIG. 6) as shown in FIG. 6.

Further, a sliding section 168 is disposed on the underside of the sliding member 158 in proximity to the center in the X axis direction so as to be in contact with and slide on the sliding surface 82 of the sub-guide rail 68 (see FIG. 6). A portion of the sliding section 168 in proximity to the center in the X axis direction has an arch shape that is slightly convex toward the side of the sliding surface 82. Further, a plurality of contact sections 170 are disposed on the top of the sliding member 158 so as to come into contact with cam sections 176 of the cam member 160.

With reference to FIGS. 19A and 19B, the cam member 160 will be described. The rack 102 is disposed on the top of the cam member 160. The top of the cam member 160 abuts against the housing 88 of the carriage 50 and serves as a supporting surface 172 that supports the housing 88. A protruding section 174 is disposed on one side of the cam member 160 in the Y axis direction (see FIG. 19A) so as to engage the engagement sections 162 of the sliding member 158.

Further, the cam section 176 having a stepped shape are disposed on the one side of the cam member 160. The cam sections 176 each include a first stepped portion 176*a*, a second stepped portion 176*c*, a third stepped portion 176*e*, a fourth stepped portion 176*g* which serve as "gap holding surfaces," and a first inclined section 176*b*, a second inclined section 176*d*, a third inclined section 176*f* which serve as "gap adjusting surfaces."

The gap PG is defined and maintained by engaging one of the first stepped portions 176*a*, the second stepped portions 176*c*, the third stepped portions 176*e*, the fourth stepped portions 176*g* with the contact sections 170 of the sliding member 158. When the cam member 160 slides relative to the sliding member 158, the gap PG is varied by the first inclined sections 176*b*, the second inclined sections 176*d* and the third inclined sections 176*f*. In the cam sections 176, the stepped portions 176*a*, 176*c*, 176*e*, 176*g* and the inclined sections 176*b*, 176*d*, 176*f* are alternatively disposed to form a stepped shape. Further, engagement sections 178 are disposed on the other side of the cam member 160 in the Y axis direction (see FIG. 19B) so as to engage the front face of the housing 88 of the carriage 50.

In the sub-gap adjusting unit 96, when the rack 102 is moved by the synchronizing unit 98 in the same direction as the direction in which the main gap adjusting unit 94 moves, the cam member 160 slides in the X axis direction relative to the sliding member 158 which is held by the housing 88. Consequently, the contact sections 170 come into contact with any of the stepped portions 176*a*, 176*c*, 176*e*, 176*g* of the cam section 176 of the cam member 160.

Referring to FIGS. 20A and 20B, the comparison of the cam sections 138 of the cam member 116 of the main gap adjusting unit 94 and the cam sections 176 of the cam member 160 of the sub-gap adjusting unit 96 will be described. FIG. 20A shows the cam sections 138 of the cam member 116 of the main gap adjusting unit 94, while FIG. 20B shows the cam member 160 of the sub-gap adjusting unit 96.

In FIGS. 20A and 20B, t1 to t8 are distances between the supporting surfaces 134, 172 and the stepped portions 138*a*, 138*c*, 138*e*, 138*g*, 176*a*, 176*c*, 176*e*, 176*g*, and L1 to L8 are lengths of the stepped portions 138*a*, 138*c*, 138*e*, 138*g*, 176*a*, 176*c*, 176*e*, 176*g* in the X axis direction. Further, coordinates X1 to X7 and X8 to X14 in the X axis direction are starting and end positions of the stepped portions. The end position of the fourth stepped portion is not shown in the figure.

The distance t1 between the first stepped portion 138*a* of the cam section 138 and the supporting surface 134 is the same as the distance t5 between the first stepped portion 176*a* of the cam section 176 and the supporting surface 172. Similarly, the distance t2 between the second stepped portion 138*c* of the cam section 138 and the supporting surface 134, the distance t3 between the third stepped portion 138*e* and the supporting surface 134, the distance t4 between the fourth stepped portion 138*g* and the supporting surface 134 are the same as the distance t6 between the second stepped portion 176*c* of the cam section 176 and the supporting surface 172, the distance t7 between the third stepped portion 176*e* and the supporting surface 172, the distance t8 between the fourth stepped portion 176*g* and the supporting surface 172, respectively.

That is, the distances t1 to t8 between the stepped portions 138*a*, 138*c*, 138*e*, 138*g*, 176*a*, 176*c*, 176*e*, 176*g* and the supporting surfaces 134, 172 are defined such that the distances in the Z axis direction for each of the stepped portions of the main gap adjusting unit 94 are consistent with the distances in the Z axis direction for each of the stepped portions of the sub-gap adjusting unit 96. Accordingly, the carriage 50 is prevented from tilting in the Y axis direction, that is, the depth direction of the apparatus.

When the main gap adjusting unit 94 and the sub-gap adjusting unit 96 are moved in the X axis direction in order to adjust the gap PG, the pinion gear shaft 108 in the synchronizing unit 98 may be distorted due to a timing when the sub-gap adjusting unit 96 starts to move being delayed from a timing when the main gap adjusting unit 94 starts to move. Moreover, backlash of the gears may also cause the timing when the sub-gap adjusting unit 96 starts to move to be delayed from the timing when the main gap adjusting unit 94 starts to move.

Accordingly, abutment positions in the sub-gap adjusting unit 96 in the X axis direction between the contact sections 170 of the sliding member 158 and the cam sections 176 may be offset from abutment positions in the main gap adjusting unit 94 in the X axis direction between the contact sections 130 of the sliding member 114 and the cam sections 138 in the direction opposite to the sliding direction of the main gap adjusting unit 94 and the sub-gap adjusting unit 96 in the scan direction, that is, the X axis direction.

To address such problem, at least one of the lengths L5 to L8 in the scan direction of the stepped portions 176*a*, 176*c*, 176*e*, 176*g* of the cam sections 176 is formed to be longer than the corresponding lengths L1 to L4 in the scan direction of the stepped portions 138*a*, 138*c*, 138*e*, 138*g* of the cam sections 138.

Further, at least one of X8, X10, X12, X14 which are starting positions of the stepped portions 176*a*, 176*c*, 176*e*, 176*g* f the cam section 176 is positioned offset from X1, X3, X5, X7 which are the corresponding starting positions of the stepped portions 138*a*, 138*c*, 138*e*, 138*g* of the cam section 138 in the direction opposite to the sliding direction of the main gap adjusting unit 94 and the sub-gap adjusting unit 96 in the scan direction, that is, the X axis direction.

Accordingly, even if the timing when the sub-gap adjusting unit 96 starts to move is delayed from the timing when the main gap adjusting unit 94 starts to move in the synchronizing unit 98, the gap PG defined by the main gap adjusting unit 94 and the gap PG defined by the sub-gap adjusting unit 96 are synchronized since the lengths of the stepped portions of the cam sections 176 in the scan direction are formed to be longer than the lengths of the stepped portions of the cam sections 138 in the scan direction, and the starting positions of the stepped portions of the cam sections 176 are positioned offset from the starting positions of the stepped portions of the cam sections 138.

As a result, the carriage 50, and thus the recording head 46 does not tilt relative to the paper sheet P in the depth direction of the apparatus, that is, the Y axis direction, and therefore, there is no or little risk of lowering the quality of recording.

In overview of the above description, the printer 10 according to this embodiment includes the carriage 50 that is provided with the recording head 46 which performs recording on the paper sheet P and is movable in the scan direction (X axis direction) of the recording head; the guide rail 64 that guides the carriage 50 in the scan direction; and the gap adjusting unit 92 that is interposed between the housing 88 of the carriage 50 and the guide rail 64 so as to displace the housing 88 of the carriage 50 in the direction in which the gap PG varies between the lower guide member 48 that supports the paper sheet P and the recording head 46, the gap adjusting unit 92 being mounted on the carriage 50. The gap adjusting unit 92 includes the sliding member 114 that slides relative to the guide rail 64, the cam member 116 that is interposed between part of the housing 88 and the sliding member 114 and has a shape that allows the housing 88 of the carriage 50 to be displaced in the direction in which the gap PG varies by sliding in the scan direction relative to the housing 88 and the sliding member 114, and the engagement member 118 that slides with the cam member 116 in the scan direction, engages the cam member 116 in the direction in which the gap PG varies in a manner that allows movement of the cam member 116, and abuts against the switching lever 152 which is configured to extend and retract with respect to the movement area of the carriage 50 to slide the cam member 116.

The engagement member 118 is provided with the movement thereof in the direction in which the gap PG varies is regulated. The guide rail 64 and the sliding member 114 engage each other with relative displacement thereof in the direction in which the gap PG varies is regulated, the sliding member 114 and the cam member 116 engage each other with relative displacement thereof in the direction in which the gap PG varies is regulated, and the cam member 116 and the housing 88 engage each other with relative displacement thereof in the direction in which the gap PG varies is regulated.

The cam member 116 engages the engagement member 118 when the second engagement pin 140 formed on the cam member 116 is loosely inserted in the elongated hole 146 formed on the engagement member 118. The elongated hole 146 is formed to be inclined by a predetermined angle relative to the direction in which the gap PG varies so that the second engagement pin 140 in the elongated hole 146 is guided to move in an appropriate direction with slide of the engagement member 118.

The printer 10 includes the first spring members 128 that applies a biasing force in a direction by which the cam member 116 is placed between the housing 88 of the carriage 50 and the sliding member 114. The guide rail 64 has a guiding surface 74 that extends in the direction in which the gap PG varies, and the sliding member 114 is biased to the guiding surface 74 by a biasing force applied between the guiding surface 74 and the housing 88 of the carriage 50 by second spring members 150.

Modification Examples of the First Embodiment (1) In the synchronizing unit 98, the second transmission gear 106 and the third transmission gear 110 may be connected via a train of gears 180 in place of the pinion gear shaft 108, as shown in FIG. 21.

(2) The main gap adjusting unit 94 and the sub-gap adjusting unit 96 may be connected by a connection member or the like instead of the synchronizing unit 98, thereby synchronizing the main gap adjusting unit 94 and the sub-gap adjusting unit 96.

(3) The switching lever 152 may be provided on the side of the sub-guide rail 68 instead of the main guide rail 66, and the protruding section 148 that engages the sub-gap adjusting unit 96 may be configured to engage the switching lever 152. In this configuration, the synchronizing unit 98 transmits a force that displaces the housing 88 of the carriage 50 in the direction in which the gap PG varies from the sub-gap adjusting unit 96 to the main gap adjusting unit 94.

(4) The switching lever 152 may be disposed between the main guide rail 66 and the sub-guide rail 68 in the direction perpendicular to the scan direction instead of on the side of the main guide rail 66, and the protruding section 148 that engages the switching lever 152 may be disposed on the pinion gear shaft 108. In this configuration, the synchronizing unit 98 transmits a force that displaces the housing 88 of the carriage 50 in the direction in which the gap PG varies to the pinion gear shaft 108 via the protruding section 148, and to both the main gap adjusting unit 94 and the sub-gap adjusting unit 96 by rotating the pinion gear shaft 108.

(5) The driving motor may be disposed between the main gap adjusting unit 94 and the sub-gap adjusting unit 96 in the synchronizing unit 98 so that the main gap adjusting unit 94 and the sub-gap adjusting unit 96 displaces the housing 88 of the carriage 50 in the direction in which the gap PG varies by driving the driving motor.

Although the gap adjusting unit 92 according to the invention is applied to the ink jet printer as an example of a recording apparatus in the above embodiments, the invention can be applied to liquid ejection apparatuses in general. The liquid ejection apparatus is not limited to a recording apparatus such as a printer having an ink jet recording head and is configured to perform recording on the recording medium by ejecting ink from the recording head, and a recording apparatus such as a copying machine and a facsimile machine, but also includes other apparatuses that eject liquid appropriate for its application instead of ink from a liquid ejection head which corresponds to the ink jet recording head on an ejection target medium which corresponds to the recording medium so that the liquid is applied on the ejection target medium.

The liquid ejection head is not limited to the recording head, but also includes color material ejecting heads used for manufacturing color filters for liquid crystal displays and the like, electrode material (electric conductive paste) ejection heads used for forming electrodes for organic electroluminescence (EL) displays, field emission displays (FED) and the like, and bioorganic ejection heads used for manufacturing bio chips, and sample ejection heads as a fine pipette.

The invention is not limited the above embodiments, and various modifications can be made within the scope of the claims of the invention. It is needless to say that such modifications are within the scope of the invention.

The entire disclosure of Japanese Patent Application No. 2012-152139, filed Jul. 6, 2012 is expressly incorporated by reference herein.

What is claimed is:

1. A recording apparatus comprising:

a carriage that is provided with a recording head which performs recording on a recording medium and is movable in a scan direction of the recording head;

a guide member that guides the carriage in the scan direction; and a gap adjusting unit that is interposed between a housing of the carriage and the guide member so as to displace the housing of the carriage in a direction in which a gap varies between a support section that supports the recording medium and the recording head, the gap adjusting unit being mounted on the carriage, wherein the gap adjusting unit includes a sliding member that slides relative to the guide member, a cam member that is interposed between part of the housing and the sliding member and has a shape that allows the housing of the carriage to be displaced in the direction in which the gap varies by sliding in the scan direction relative to the housing and the sliding member, and an engagement member that slides with the cam member in the scan direction, engages the cam member in the direction in which the gap varies in a manner that allows movement of the cam member, and abuts against the switching member which is configured to extend and retract with respect to a movement area of the carriage to slide the cam member.

2. The recording apparatus according to claim 1, wherein the engagement member is provided with movement thereof in the direction in which the gap varies is regulated.

3. The recording apparatus according to claim 1, wherein the guide member and the sliding member engage each other with relative displacement thereof in the direction in which the gap varies is regulated, the sliding member and the cam member engage each other with relative displacement thereof in the direction in which the gap varies is regulated, and the cam member and the housing engage each other with relative displacement thereof in the direction in which the gap varies is regulated.

4. The recording apparatus according to claim 1, wherein the cam member engages the engagement member when a projection formed on the cam member is loosely inserted in an elongated hole formed on the engagement member, and the elongated hole is formed to be inclined by a predetermined angle relative to the direction in which the gap varies so that the projection in the elongated hole is guided to move in an appropriate direction with slide of the engagement member.

5. The recording apparatus according to claim 1, further comprising a first biasing unit that applies a biasing force in a direction by which the cam member is placed between the housing of the carriage and the sliding member.

6. The recording apparatus according to claim 1, wherein the guide member has a wall that extends in the direction in which the gap varies, and the sliding member is biased to the wall by a biasing force applied between the wall and the housing of the carriage by a second biasing unit.

* * * * *